US008942603B2

(12) United States Patent
Sato

(10) Patent No.: US 8,942,603 B2
(45) Date of Patent: Jan. 27, 2015

(54) DEVELOPING DEVICE AND IMAGE FORMING APPARATUS

(71) Applicant: Oki Data Corporation, Tokyo (JP)

(72) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 58 days.

(21) Appl. No.: 13/905,771

(22) Filed: May 30, 2013

(65) Prior Publication Data

US 2013/0322931 A1 Dec. 5, 2013

(30) Foreign Application Priority Data

May 30, 2012 (JP) ..... 2012-123691

(51) Int. Cl.
*G03G 15/08* (2006.01)

(52) U.S. Cl.
CPC ..... *G03G 15/0808* (2013.01)
USPC ..... 399/279; 399/176; 399/313; 399/117; 399/119

(58) Field of Classification Search
USPC ..... 399/176, 279, 313, 117, 119
See application file for complete search history.

(56) References Cited

U.S. PATENT DOCUMENTS 6,229,982 B1 * 5/2001 Yamauchi et al. ..... 399/327
7,113,723 B2 * 9/2006 Saito ..... 399/101

FOREIGN PATENT DOCUMENTS

JP 2007-093775 A 4/2007

* cited by examiner

*Primary Examiner* — Walter L Lindsay, Jr.
*Assistant Examiner* — Roy Y Yi
(74) *Attorney, Agent, or Firm* — Kubotera & Associates, LLC

(57) ABSTRACT

A developing device includes a static latent image supporting member having a photosensitive layer and being arranged to be rotatable; a developer supporting member arranged to be rotatable for developing a static latent image formed on the static latent image supporting member using developer to form an image; a developer supplying member arranged to contact with the developer supporting member and be rotatable for supplying developer; and a drive transmission unit disposed on a side of same end portions of the developer supporting member and the developer supplying member for rotating the developer supporting member and the developer supplying member in a same rotational direction. The developer supplying member is formed so that an outer diameter thereof on a side of the drive transmission unit becomes smaller than an outer diameter thereof on an opposite side.

7 Claims, 12 Drawing Sheets

DEVELOPING DEVICE AND IMAGE FORMING APPARATUS

BACKGROUND OF THE INVENTION AND RELATED ART STATEMENT

The present invention relates to a developing device and an image forming apparatus for forming an image.

In an electro-photography type image forming apparatus as a conventional image forming apparatus, a charging roller as a charging member is arranged to uniformly charge a surface of a photosensitive member as an image supporting member. An exposure unit is arranged to form a static latent image on the photosensitive drum, and a developing device is arranged to form a toner image on the static latent image on the photosensitive drum. The developing device includes a developing roller as a developer supporting member; a supplying roller as a developer supplying member for supplying toner as developer to the developing roller; and a regulating blade as a developer layer forming member for forming a toner thin layer on the developing roller.

In the conventional image forming apparatus, after the toner image is transferred to a sheet, a cleaning blade formed of a rubber plate member is arranged to collect toner remaining on the photosensitive drum. Further, a fixing device is arranged to fix the toner image on the sheet, and the sheet is discharged outside the conventional image forming apparatus. The conventional image forming apparatus may include a plurality of developing devices arranged in series for forming toner images in four colors, namely, black, cyan, magenta, and yellow, so that it is possible to form a color image.

In the conventional image forming apparatus described above, it may configured such that a toner supply voltage applied to the supplying roller is controlled according to a detection result of toner attached to a non-exposed region of the photosensitive drum or an area of a transfer member corresponding to the non-exposed region of the photosensitive drum. Accordingly, it is possible to prevent a stain from generating on the sheet (refer to Patent Reference).

Patent Reference: Japanese Patent Publication No. 2007-093775

In the conventional image forming apparatus disclosed in Patent Reference, it is configured such that the toner supply voltage applied to the supplying roller is controlled, so that an amount of toner supplied to the supplying roller is adjusted. However, when an outer circumferential portion (a rubber portion) of the supplying roller is worn out, the amount of toner supplied to the supplying roller tends to be excessive, thereby causing a stain on the sheet.

In view of the problems described above, an object of the present invention is to provide a developing device and an image forming apparatus capable of solving the problems of the conventional developing device and the conventional image forming apparatus. In the present invention, it is possible to reduce a stain generated on a sheet.

Further objects and advantages of the invention will be apparent from the following description of the invention.

SUMMARY OF THE INVENTION

In order to attain the objects described above, according to an aspect of the present invention, a developing device includes a static latent image supporting member having a photosensitive layer and being arranged to be rotatable; a developer supporting member arranged to be rotatable for developing a static latent image formed on the static latent image supporting member using developer to form an image; a developer supplying member arranged to contact with the developer supporting member and be rotatable for supplying developer; and a drive transmission unit disposed on a side of same end portions of the developer supporting member and the developer supplying member for rotating the developer supporting member and the developer supplying member in a same rotational direction. The developer supplying member is formed so that an outer diameter thereof on a side of the drive transmission unit becomes smaller than an outer diameter thereof on an opposite side.

In the developing device and the image forming apparatus of the present invention, it is possible to reduce a stain generated on a sheet.

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 2:
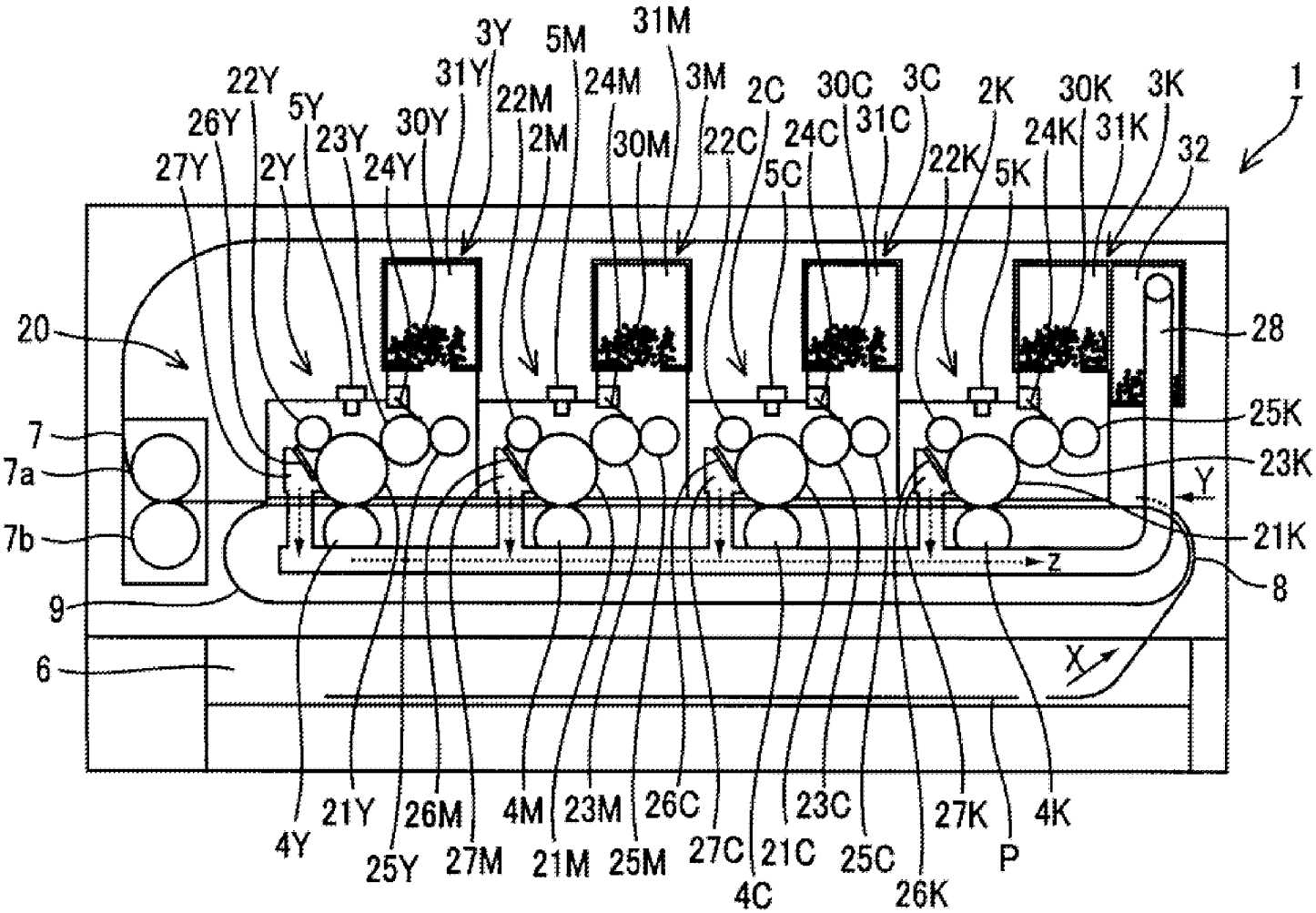
FIG. 2 is a schematic sectional view showing a configuration of the image forming apparatus according to the first embodiment of the present invention.

A first embodiment of the present invention will be explained. FIG. 2 is a schematic sectional view showing a configuration of a printer 1 as an image forming apparatus according to the first embodiment of the present invention.

As shown in FIG. 2, the printer 1 includes developing devices 2 (2K, 2C, 2M, and 2Y) corresponding to toner 30 (30K, 30C, 30M, and 30Y) as developer in four colors of black (B), cyan (C), magenta (M), and yellow (Y); toner cartridges 3 (3K, 3C, 3M, and 3Y) for retaining the toner 30 (30K, 30C, 30M, and 30Y); and transfer units 4 (4K, 4C, 4M, and 4Y) for transferring toner images developed on photosensitive drums 21 (21K, 21C, 21M, and 21Y; described later) as static latent image supporting member to a sheet P as a transfer medium.

In the first embodiment, the printer 1 further includes exposure units 5 (5K, 5C, 5M, and 5Y) for irradiating surfaces of the photosensitive drums 21 to form the static latent images thereon; a sheet supply cassette 6 for retaining the sheet P and supplying the sheet P in an arrow direction X; a fixing unit 7 for fixing the toner images transferred to the sheet P; and a sheet transportation path 8 formed in an S character shape relative to a lower frame of the printer 1.

In the first embodiment, the developing devices 2K, 2C, 2M, and 2Y are sequentially disposed along the sheet transportation path 8 from a sheet supply side to a sheet discharge side of the sheet P in a sheet transportation direction Y from an upstream side to a downstream side. Further, the developing devices 2K, 2C, 2M, and 2Y are integrated as an image forming unit 20, and arranged to be freely detachable relative to the printer 1. The developing devices 2K, 2C, 2M, and 2Y have an identical configuration except colors of the toner 30K, 30C, 30M, and 30Y to be developed. Accordingly, in the following description, only the configuration of the developing device 2K for developing the toner 30K in black, and explanations of the configurations of the other developing devices 2C, 2M, and 2Y are omitted.

In the first embodiment, the developing device 2K includes the photosensitive drum 21K as the static latent image supporting member arranged to be rotatable and having a photosensitive layer; a charging roller 22K as a charging member for uniformly charging the surface of the photosensitive drum 21K; a developing roller 23K arranged to be rotatable for developing the toner 30K to the static latent image formed on the photosensitive drum 21K to form an image; and a developing blade 24K as a toner layer regulating member for regulating a layer thickness of the toner 30K supplied to the developing roller 23K.

In the first embodiment, the developing device 2K further includes a supplying roller 25K as a developer supplying member arranged to be rotatable and contact with the developing roller 23K for supplying the toner 30K to the developing roller 23K; a cleaning blade 26K as a toner removing member or a cleaning member for removing the remaining toner 30K remaining on the photosensitive drum 21K and not transferred to the sheet P; and a first transportation unit 27K as a transportation member for transporting the remaining toner 30K removed with the cleaning blade 26K as the waste toner 30K.

In the first embodiment, the photosensitive drum 21K is formed of a conductive supporting member and a photoconductive layer. More specifically, the photosensitive drum 21K is formed of a metal pipe such as aluminum and the like as the conductive supporting member. Further, a blocking layer and the photoconductive layer of an electron charge generation and an electron charge transportation layer are sequentially laminated on the metal pipe, thereby constituting an organic photosensitive member. The charging roller 22K is formed of a metal shaft and a semi-conductive rubber layer such as an epichlorohydrin rubber. It should be noted that an outer circumferential surface of the charging roller 22K is arranged to abut against an outer circumferential surface of the photosensitive drum 21K with a specific pressing force, so that the charging roller 22K follows and rotates when the photosensitive drum 21K rotates.

In the first embodiment, the developing roller 23K is formed of a metal shaft and a semi-conductive urethane rubber layer. It should be noted that an outer circumferential surface of the developing roller 23K is arranged to abut against the outer circumferential surface of the photosensitive drum 21K with a specific pressing force, so that the charging roller 22K follows and rotates while maintaining a specific circumferential speed ratio in a direction that the photosensitive drum 21K rotates.

In the first embodiment, the developing blade 24K is formed of a metal thin plate member for regulating the layer thickness of the toner 30. The developing blade 24K has a thickness of, for example, 0.08 mm and a length substantially equal to a length of the developing roller 23K in a longitudinal direction thereof. The developing blade 24K has one end portion fixed to a frame (not shown), and an inner side surface slightly inside a distal end portion of the other end portion is arranged to abut against the developing roller 23K.

In the first embodiment, the supplying roller 25K is formed of a metal shaft and a semi-conductive foamed silicone sponge layer. It should be noted that an outer circumferential surface of the supplying roller 25K is arranged to abut against the outer circumferential surface of the photosensitive drum 21K with a specific pressing force, so that the charging roller 22K rotates while maintaining a specific circumferential speed ratio in a direction opposite to the direction that the developing roller 23K is rotated.

In the first embodiment, the cleaning blade 26K is formed of a urethane rubber member. The cleaning blade 26K has a length substantially equal to a length of the photosensitive drum 21K in a longitudinal direction thereof. The developing blade 24K has one end portion extending in a longitudinal direction thereof and fixed to the frame (not shown), and the other end portion arranged to abut against the outer circumferential surface of the photosensitive drum 21K with a specific pressing force.

In the first embodiment, the first transportation unit 27K is arranged to transport the remaining toner 30K and an attached substance removed with the cleaning blade 26K as the waste toner 30K toward a front side in a rotational axis direction of the photosensitive drum 21K. A second transportation unit 28 is arranged to collectively transport the waste toner 30K, 30C, 30M, and 30Y transported from the first transportation units 27K, 27C, 27M, and 27K disposed in the developing devices 2K, 2C, 2M, and 2Y in an arrow direction Z.

In the first embodiment, the toner cartridges 3K, 3C, 3M, and 3Y respectively include supply toner storage portions 31K, 31C, 31M, and 31Y having a hollow structure for retaining the unused toner 30K, 30C, 30M, and 30Y in the four colors of black (K), cyan (C), magenta (M) and yellow (Y). Among the toner cartridges 3K, 3C, 3M, and 3Y, only the toner cartridge 3K of black (K), which is disposed at the most upstream position of the sheet transportation path 8 in the sheet transportation direction, includes a waste toner storage portion 32 disposed adjacent to the supply toner storage portion 31K. The waste toner storage portion 32 has an independent space disposed adjacent to the supply toner storage portion 31K for retaining the waste toner 30K, 30C, 30M, and 30Y transported with the second transportation unit 28.

In the first embodiment, each of the image forming unit 20 and the toner cartridges 3K, 3C, 3M, and 3Y is configured to be a replacement unit of the printer 1, so that the replacement unit is detachable relative to the printer 1. Accordingly, when the toner 30K, 30C, 30M, and 30Y retained therein is consumed, or a component thereof is worn, it is possible to replace each of the image forming unit 20 and the toner cartridges 3K, 3C, 3M, and 3Y.

In the first embodiment, the transfer unit 4 includes a transfer belt 9 for statically attaching and transporting the sheet P; a drive roller (not shown) driven with a drive unit (not shown) to rotate for driving the transfer belt 9; a tension roller (not shown) to be paired with the drive roller for extending the transfer belt 9; and transfer rollers 4K, 4C, 4M, and 4Y arranged to face the photosensitive drum 21K, 21C, 21M, and 21Y with the transfer belt 9 in between for applying a voltage, so that the toner images formed on the photosensitive drum 21K, 21C, 21M, and 21Y are transferred to the sheet P. The exposure units 5K, 5C, 5M, and 5Y are formed of LED (Light Emitting Diode) heads including a light emitting element such as an LED and the like and a lens array.

In the first embodiment, the sheet supply cassette 6 is configured to retain the sheet P therein in a stacked state, and is detachably attached to a lower portion of the printer 1. A sheet transportation unit (not shown) is disposed at an upper portion of the sheet supply cassette 6, and the sheet transportation unit includes a hopping roller and the like for picking up and feeding the sheet P one by one. The fixing unit 7 is disposed on a downstream side of the image forming unit 20 in the sheet transportation direction of the sheet transportation path 8. The fixing unit 7 includes a heating roller 7*a*, a pressing roller 7*b*, a thermistor (not shown), and a heating heater.

In the first embodiment, the heating roller 7*a* includes a metal core formed of aluminum and the like and having a hollow cylindrical shape; a heat resistance elastic layer formed of a silicone rubber and covering the metal core; and a PFA (tetrafluoroethylene-perfluoroalkylvinylether copolymer) tube covering the heat resistance elastic layer. The heating heater such as a halogen lamp is disposed in the metal core of the heating roller 7*a*. Similarly, the pressing roller 7*b* includes a metal core formed of aluminum; a heat resistance elastic layer formed of a silicone rubber and covering the metal core; and a PFA tube covering the heat resistance elastic layer. The pressing roller 7*b* is arranged to form a pressing portion (an abutting portion) with respect to the heating roller 7*a*. The thermistor is provided as a surface temperature detection member of the heating roller 7*a*, and is arranged at a close proximity of the heating roller 7*a* in a non-contact state.

Figure 3:
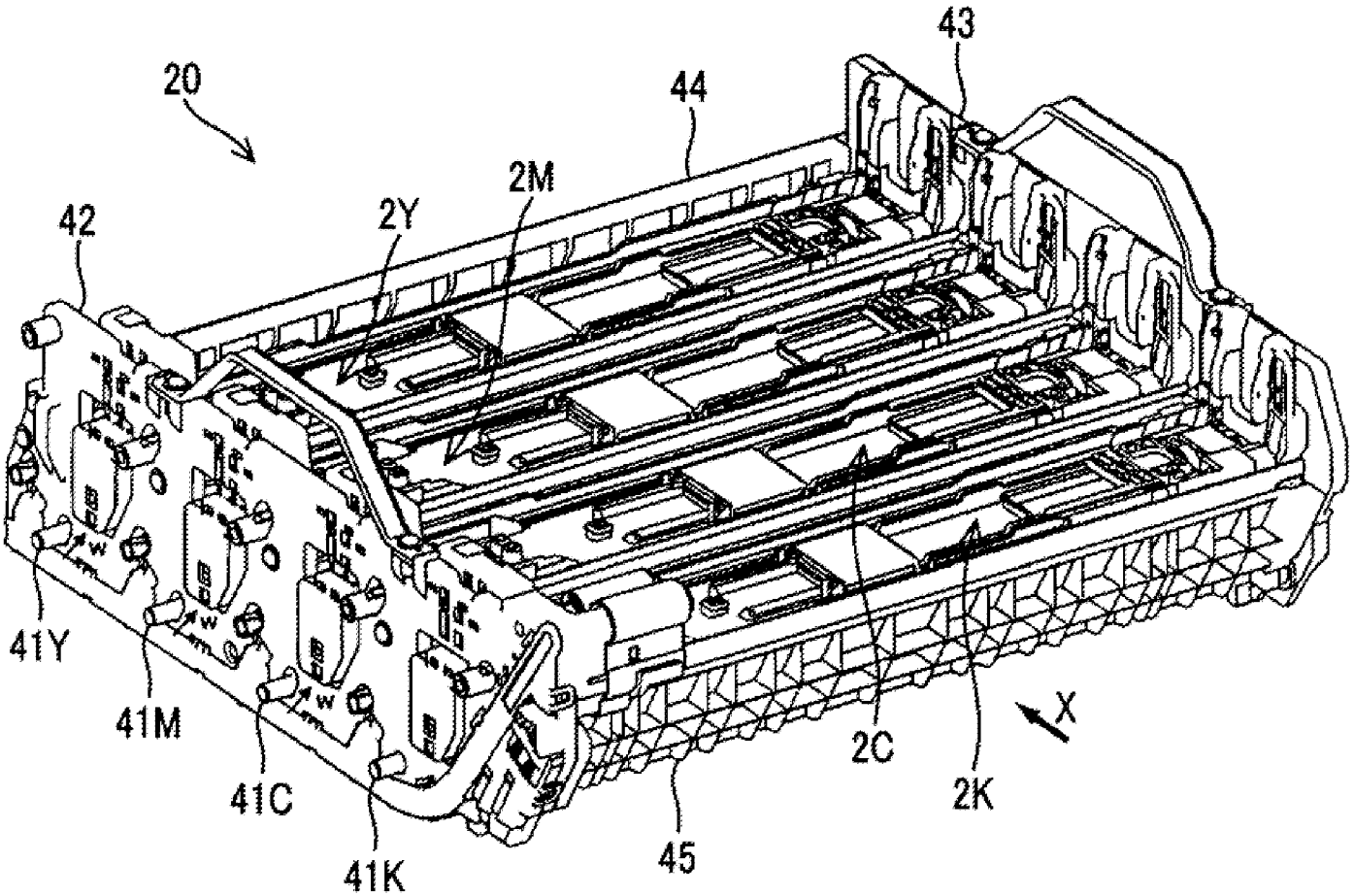
FIG. 3 is a schematic sectional view showing an image forming unit of the image forming apparatus according to the first embodiment of the present invention.

FIG. 3 is a schematic sectional view showing the image forming unit 20 of the printer 1 as the image forming apparatus according to the first embodiment of the present invention.

As shown in FIG. 3, in the image forming unit 20, the developing devices 2K, 2C, 2M, and 2Y in each color are arranged at a constant interval. A first side frame 42 with high rigidity and a second side frame 43 with high rigidity are provided for supporting both side portions of each of the developing devices 2K, 2C, 2M, and 2Y in a medium transportation direction (an arrow direction X in FIG. 3). Further, a front frame 44 and a back frame 45 are provided for supporting both end portions of each of the developing devices 2K, 2C, 2M, and 2Y in the medium transportation direction.

In the first embodiment, photosensitive drum shafts 41K, 41C, 41M, and 41Y with specific rigidity are provided as a photosensitive drum rotation supporting member, and are formed of a metal with sufficient conductivity. When the image forming unit 20 is attached or detached, the photosensitive drum shafts 41K, 41C, 41M, and 41Y are moved along a guide (not shown) in the printer 1. Further, it is configured such that the photosensitive drum shafts 41K, 41C, 41M, and 41Y are capable of moving in an arrow direction W in FIG. 3 with a developing device lifting up mechanism (not shown), so that the developing devices 2K, 2C, 2M, and 2Y are capable of moving away from the transfer belt 9 shown in FIG. 2.

Figure 1A:
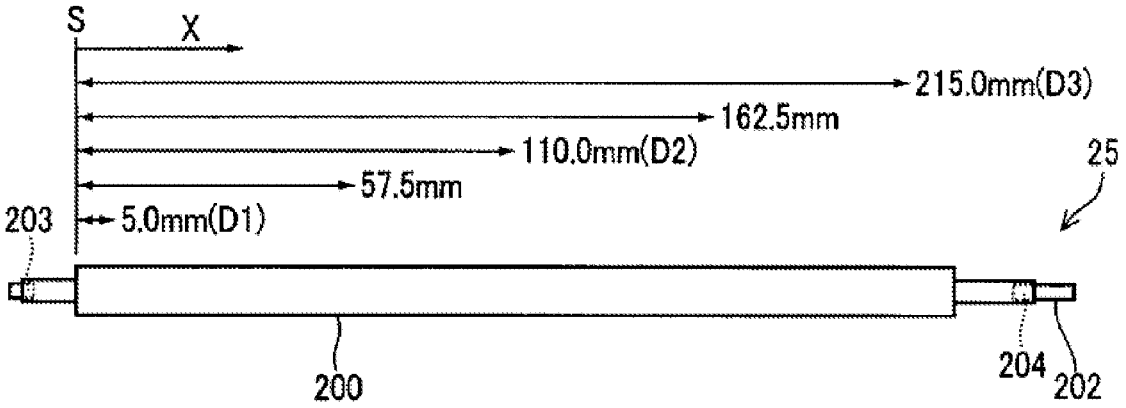
FIGS. 1(*a*) and 1(*b*) are schematic views showing a supplying roller of an image forming apparatus according to a first embodiment of the present invention, wherein FIG. 1(*a*) is a schematic front view showing the supplying roller of the image forming apparatus, and FIG. 1(*b*) is a schematic enlarged view showing a conductive foamed layer of the supplying roller of the image forming apparatus.
Figure 1B:
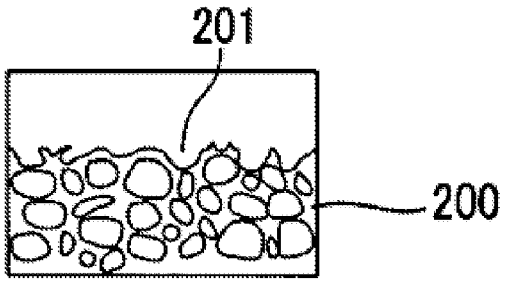

FIGS. 1(*a*) and 1(*b*) are schematic views showing the supplying roller 25 of the printer 1 as the image forming apparatus according to a first embodiment of the present invention. More specifically, FIG. 1(*a*) is a schematic front view showing the supplying roller 25 of the printer 1, and FIG. 1(*b*) is a schematic enlarged view showing a conductive foamed layer 200 of the supplying roller 25 of the printer 1.

As shown in FIG. 1(*a*), the supplying roller 25 includes a shaft 202 as a metal core and the conductive foamed layer 200 disposed on a circumference (a surface layer) of the shaft 202. As shown in FIG. 1(*b*), the conductive foamed layer 200 includes a large number of cells (foamed cells) 201.

In the first embodiment, the conductive foamed layer 200 is formed of a rubber material including a rubber material such as a silicone rubber, a silicone-modified rubber, a natural rubber, a nitrile rubber, an ethylene-propylene rubber, an EPDM, a styrene-butadiene rubber, an acrylonitrile-butadiene rubber, a butadiene rubber, an isoprene rubber, an acryl rubber, a chloroprene rubber, a butyl rubber, an epichlorohydrin rubber, a urethane rubber, a fluorine rubber, a polyether rubber, and the like; an elastomer such as polyurethane, polystyrene, a polybutadiene block copolymer, polyolefin, polyethylene, a chlorinated polyethylene, an ethylene-vinyl acetate copolymer, and the like; or a mixture rubber or a modified rubber of one or more than two of the materials described above. It should be noted that the rubber materials described above can be arbitrarily selected from a millable type or a liquid type. In particular, it is preferred that the rubber materials are the millable type.

In the first embodiment, the shaft 202 may be formed of a metal material with specific rigidity and sufficient conductivity including steel, capper, stainless, aluminum, nickel, and the like. Further, the shaft 202 may be formed of a material other than the metal material as far as the material possesses conductivity and sufficient rigidity. For example, the material includes a resin molded component and a ceramic material in which conductive particles are dispersed. Further, the shaft may be formed in a hollow pipe shape other than the roller shape.

In the first embodiment, gear attachment step portions 203 and 204 are formed on both end portions of the shaft 202. A pin hole may be formed in the both end portions of the shaft 202. Further, a bearing portion is formed on the both end portions of the shaft 202, and the bearing portion may be generally formed to have a diameter smaller than that of the shaft 202 where the conductive foamed layer 200 is disposed.

In the first embodiment, when the supplying roller 25 is produced, first, a reinforcement filler, a vulcanization agent necessary for vulcanization, a foaming agent, and a conductivity imparting agent are added to the rubber material described above to obtain a mixture. In the next step, after the mixture is thoroughly mixed with a pressure kneader, a mixing roll, and the like to obtain a rubber compound, the rubber compound is formed on the shaft 202 in an un-vulcanized state with an extruding method and the like. Then, the rubber compound is heated for vulcanization and foaming.

Alternatively, the rubber compound may be extruded in a tube shape in advance, and then is heated for vulcanization and foaming to form a sponge rubber tube. Then, the sponge rubber tune is placed on the shaft 202 to produce the supplying roller 25. In this method, as necessary, an adhesive may be applied between the shaft 202 and the conductive foamed layer 200 for fixing. Afterward, the supplying roller 25 thus produced is machined and ground to have a specific outer diameter.

In the first embodiment, the conductive foamed layer 200 of the supplying roller 25 has a length of 220.0 mm in a rotational axis direction. As shown in FIG. 1(*a*), three points D1, D2, and D3 are defined. The point D1 is located at a position 5.0 mm away from a left end portion (an end portion on a non-drive transmission side) of the conductive foamed layer 200 of the supplying roller 25 toward a right end portion where a drive gear is disposed (an end portion on a driven side). Similarly, the point D2 is located at a position away from the left end portion by 110.0 mm, and the point D3 is located at a position away from the left end portion by 215.0 mm. Further, a distance from the left end portion (the end portion on the non-drive transmission side) of the conductive foamed layer 200 of the supplying roller 25 is defined as X (mm).

Figure 4A:
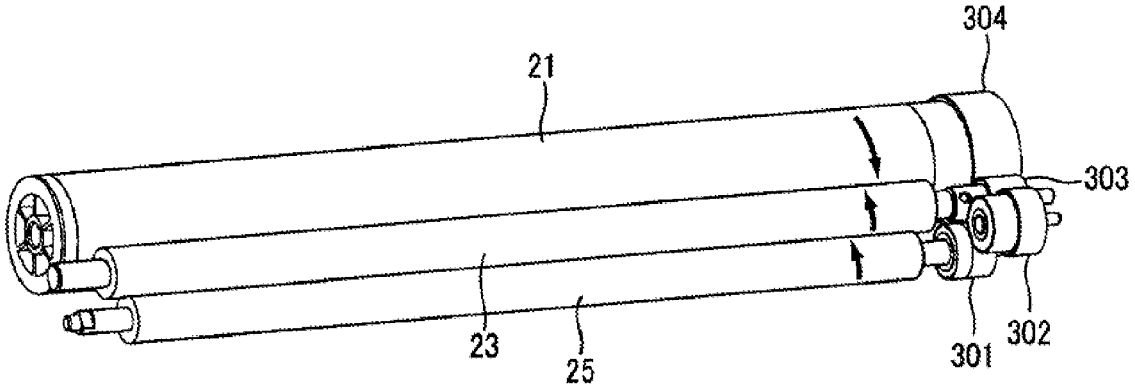
FIGS. 4(*a*) and 4(*b*) are schematic views showing the supplying roller, a developing roller, a photosensitive drum, and drive gears of the image forming apparatus according to the first embodiment of the present invention, wherein FIG. 4(*a*) is a schematic perspective view showing the supplying roller, the developing roller, the photosensitive drum, and the drive gears of the image forming apparatus, and FIG. 4(*b*) is a schematic side view showing the drive gears of the image forming apparatus.
Figure 4B:
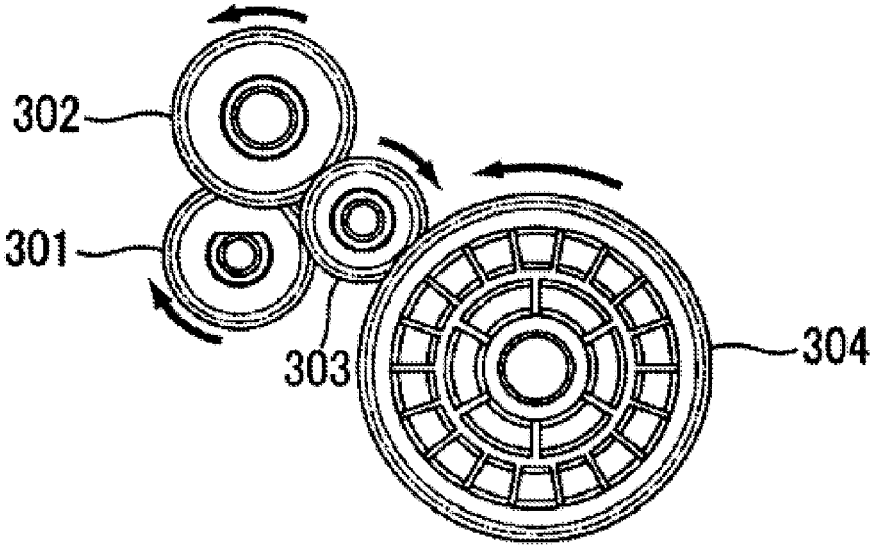

FIGS. 4(*a*) and 4(*b*) are schematic views showing the supplying roller 25, the developing roller 24, the photosensitive drum 21, and drive gears of the printer 1 as the image forming apparatus according to the first embodiment of the present invention. More specifically, FIG. 4(*a*) is a schematic perspective view showing the supplying roller 25, the developing roller 24, the photosensitive drum 21, and the drive gears of the printer 1 as the image forming apparatus, and FIG. 4(*b*) is a schematic side view showing the drive gears of the printer 1 as the image forming apparatus.

As shown in FIG. 4(*a*), the drive gears as a drive transmission unit are disposed on a same side of the end portions of the supplying roller 25, the developing roller 23 and the photosensitive drum 21. Accordingly, it is configured such that the developing roller 23 is rotated in a rotational direction the same as that of the supplying roller 25.

As shown in FIG. 4(*a*), the drive gears includes a developing roller gear 303 as a first gear, a supplying roller gear 301 as a second gear, and a drive transmission gear 302 as a third gear. The supplying roller gear 301 is disposed at the one end portion of the rotational axis of the supplying roller 25, and is connected to the drive transmission gear 302. The developing roller gear 303 is disposed at the one end portion of the rotational axis of the developing roller 23, so that the developing roller gear 303 transmits a drive force to the drive transmission gear 302. A photosensitive drum gear 304 is disposed at the one end portion of the rotational axis of the photosensitive drum 21, so that the photosensitive drum gear 304 transmits the drive force to the developing roller gear 303. The photosensitive drum gear 304 is configured to receive the drive force from a drive motor gear (not shown).

Figure 6:
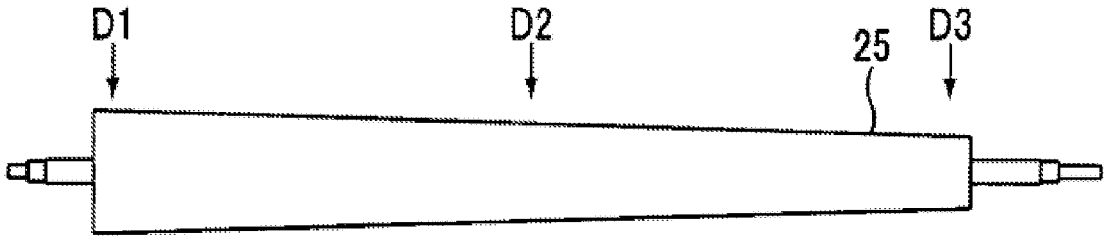
FIG. 6 is a schematic side view showing the supplying roller of the image forming apparatus according to the first embodiment of the present invention.

FIG. 6 is a schematic side view showing the supplying roller 25 of the printer 1 as the image forming apparatus according to the first embodiment of the present invention.

As shown in FIG. 6, the supplying roller 25 has a largest outer diameter ϕD1 at the point D1, and an outer diameter ϕD2 at the point D2 and an outer diameter ϕD3 at the point D3 are gradually decreased in this order. In other words, the supplying roller 25 is configured such that the outer diameter thereof is decreased from the side of the drive transmission unit toward the non-drive transmission side. Further, the supplying roller 25 is configured such that the outer circumferential surface thereof becomes smooth along a continuous straight line or a curved line between the points D1, D2, and D3 obtained through a conventional polishing method. Alternatively, the supplying roller 25 is configured such that the outer circumferential surface thereof becomes stepwise.

An experiment of evaluating a continuous durability of the supplying roller 25 will be explained next. In the experiment, a continuous durability print test was conducted using Sample 1 to Sample 4 having different shapes. More specifically, Sample 1 had a straight cylindrical shape having an identical outer diameter of ϕD1, ϕD2, and ϕD3. Sample 2 had the outer diameter ϕD3 smaller than the outer diameter ϕD1 by about 0.2 mm. Sample 3 had the outer diameter ϕD3 smaller than the outer diameter ϕD1 by about 0.4 mm. Sample 4 had the outer diameter ϕD3 smaller than the outer diameter ϕD1 by about 0.6 mm. The outer diameter profiles of Sample 1 to Sample 4 in an initial state are shown in Table 1.

TABLE 1

| | Outer diameter ϕ in initial state (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 12.29 | 12.31 | 12.32 | 12.31 | 12.29 |
| Sample 2 | 12.31 | 12.26 | 12.23 | 12.17 | 12.09 |
| Sample 3 | 12.30 | 12.22 | 12.14 | 12.05 | 11.92 |
| Sample 4 | 12.29 | 12.14 | 12.01 | 11.85 | 11.67 |

An effect of the configuration described above will be explained. First, an operation of the printer 1 as the image forming apparatus will be explained next with reference to FIG. 2.

After the printer 1 receives print data, the developing devices 2K, 2C, 2M, and 2Y are driven, so that the toner 30K, 30C, 30M, and 30Y are supplied from the toner cartridges 3K, 3C, 3M, and 3Y. Further, after the printer 1 receives the print data, the printer 1 feeds the sheet P in the sheet supply cassette 6 in the arrow direction X, so that the sheet P is transported along the sheet transportation path 8 in the arrow direction Y. When the sheet P is transported, the sheet P sequentially passes below the developing devices 2K, 2C, 2M, and 2Y. At this moment, the exposure units (the LED heads) 5K, 5C, 5M, and 5Y respectively expose the photosensitive drums 21K, 21C, 21M, and 21Y to form the toner images thereon, and the transfer unit 4 transfers the toner images to the sheet P. Afterward, the fixing unit 7 fixes the toner images to the sheet P, and the sheet P is discharged outside the printer 1.

In the first embodiment, the developing devices 2K, 2C, 2M, and 2Y basically perform an identical operation. Accordingly, in the following description, an operation of the developing device 2K for developing the toner 30K in black (K) will be explained, and explanation of the operation of the developing devices 2C, 2M, and 2Y is omitted.

In the first embodiment, the charging roller 22K is configured to uniformly charge the surface of the photosensitive drum 21K, and the exposure unit 5K exposes the photosensitive drum 21K to form the static latent image thereon. A charge roller power source (not shown) is connected to the charging roller 22K for applying a bias voltage having a polarity the same as that of the toner 30K. When the charge roller power source applies the bias voltage to the charging roller 22K, the charging roller 22K uniformly charges the surface of the photosensitive drum 21K. A developing roller power source (not shown) is connected to the developing roller 23K for applying a bias voltage having a polarity the same as or opposite to that of the toner 30K. When the developing roller power source applies the bias voltage to the developing roller 23K, the developing roller 23K is configured to attach the toner 30K thus charged to the static latent image on the photosensitive drum 21K to form the toner image.

In the first embodiment, the developing roller power source (not shown) or the charge roller power source (not shown) is connected to the developing blade 24K for applying a bias voltage having a polarity the same as or opposite to that of the toner 30K. When the developing roller power source or the charge roller power source applies the bias voltage to the developing blade 24K, the developing blade 24K charges the toner 30K and regulates the layer thickness of the toner 30K on the developing roller 23K along with the abutting force thereof. A supplying roller power source (not shown) is connected to the supplying roller 23K for applying a bias voltage having a polarity the same as or opposite to that of the toner 30K. When the supplying roller power source applies the bias voltage to the supplying roller 23K, the supplying roller 23K is configured to supply the toner 30K supplied from the supply toner storage portion 31K as the developer storage portion of the toner cartridge 3K to the developing roller 23K. Further, the supplying roller 25K is arranged to abut against the developing roller 23K, so that the supplying roller 25K charges the toner 30K with a contact frictional force relative to the developing roller 23K.

In the first embodiment, the cleaning blade 26K is arranged to scrape off the toner 30K remaining on the surface of the photosensitive drum 21K after the toner image is transferred to the sheet P. Further, the cleaning blade 26K is also arranged to scrape off a small amount of a foreign substance attached to the surface of the photosensitive drum 21K from the transfer belt 9.

In the first embodiment, the first transportation unit 27K is arranged to transport the remaining toner 30K and the attached substance removed with the cleaning blade 26K as the waste toner 30K toward the front side in FIG. 2 in the rotational axis direction of the photosensitive drum 21K. After the first transportation unit 27K transports the waste toner 30K, the second transportation unit 28 transports the waste toner 30K to the waste toner storage portion (the waste substance storage portion) 32. The second transportation unit 28 as the transportation unit is connected to the first transportation unit 27K to form the transportation path of the waste toner 30K.

In the first embodiment, the second transportation unit 28 is arranged to collectively transport the waste toner 30K, 30C, 30M, and 30Y transported from the first transportation units 27K, 27C, 27M, and 27K disposed in the developing devices 2K, 2C, 2M, and 2Y in the arrow direction Z in FIG. 2. A stirring supply member (not shown) is disposed in each of the toner storage portions 31K, 31C, 31M, and 31Y of the toner cartridges 3K, 3C, 3M, and 3Y for supplying the toner 30K, 30C, 30M, and 30Y in the unused state to the developing devices 2K, 2C, 2M, and 2Y, respectively.

In the first embodiment, in the transfer unit 4, a transfer roller power source (not shown) or the charge roller power source (not shown) is connected to the transfer rollers 4K, 4C, 4M, and 4Y for applying a bias voltage having a polarity the same as or opposite to that of the toner 30K. When the transfer roller power source applies the bias voltage to the transfer rollers 4K, 4C, 4M, and 4Y, the transfer rollers 4K, 4C, 4M, and 4Y are arranged to transfer the toner images formed on the photosensitive drums 21K, 21C, 21M, and 21Y to the sheet P transported from the sheet supply cassette 6. It should be noted that the exposure units 5K, 5C, 5M, and 5Y are configured to irradiate light on the photosensitive drums 21K, 21C, 21M, and 21Y, respectively, according to the print data thus input, so that a potential of a light irradiated are is optically decreased to form the static latent image.

In the first embodiment, after the sheet P stored in the sheet supply cassette 6 is transported to a sheet supply portion in the arrow direction X, a transportation roller (not shown) is arranged to transport the sheet P to the image forming unit 20. In the fixing unit 7, the heating heater is controlled according to the surface temperature of the heating roller 7*a* detected with the thermistor. Accordingly, it is possible to maintain the surface temperature of the heating roller 7*a* at a specific level. While the surface temperature of the heating roller 7*a* is maintained at a specific level, after the toner images are transferred to the sheet P, the sheet P passes through the pressing portion between the heating roller 7*a* and the pressing roller 7*b*, so that heat and pressure are applied to the sheet P and the toner 30K, 30C, 30M, and 30Y, thereby fixing the toner images to the sheet P.

An operation of the image forming unit 20 will be explained next with reference to FIG. 3. As shown in FIG. 3, the image forming unit 20 includes the developing devices 2K, 2C, 2M, and 2Y integrated in one unit, so that the image forming unit 20, in which the developing devices 2K, 2C, 2M, and 2Y are integrated, is detachably attached to the printer 1. When the printer 1 performs a color printing operation, the photosensitive drum shafts 41K, 41C, 41M, and 41Y are arranged in an image forming position with own weight along a guide disposed in the printer 1, so that the developing devices 2K, 2C, 2M, and 2Y perform the printing operation.

When the printer 1 performs a monochrome printing operation, a developing device lifting mechanism (not shown) is configured to lift up the photosensitive drum shafts 41C, 41M, and 41Y in an arrow direction W in FIG. 3. Accordingly, the developing devices 2C, 2M, and 2Y are moved to a non-image forming position, so that only the developing device 2K is situated at the image forming position to perform the printing operation.

The configuration of the supplying roller 25 will be explained in more detail next with reference to FIGS. 1 and 4. The supplying roller 25 includes a base member formed of a foamed silicone rubber compound. The cells 201 of the conductive foamed layer 200 are separate foamed cells individually independent. The conductive foamed layer 200 of the supplying roller 25 generally has hardness of 45° to 65° measured with an Asker F hard meter (a product of KOBUNSHI KEIKI CO., LTD.). In the first embodiment, the conductive foamed layer 200 of the supplying roller 25 has hardness of 47°.

The cells 201 of the conductive foamed layer 200 generally have a size (a diameter) of 100 μm to 1,000 μm. In the first embodiment, the cells 201 have a size (a diameter) of 200 μm to 200 μm at a surface of the conductive foamed layer 200. A resistivity value of the supplying roller 25 is measured when a voltage of 300V is applied through the shaft 202 while the supplying roller 25 is rotating in a state that the supplying roller 25 contacts with a ball barring made of an SUS material having a width of 2.0 mm and a diameter of 6.0 mm with a force of 20 gf. It is preferred to adjust the resistivity value of the supplying roller 25 between 1 MΩ and 100 MΩ. In the first embodiment, the resistivity value of the supplying roller 25 is adjusted to be 10 MΩ.

In the first embodiment, the conductive foamed layer 200 of the supplying roller 25 has a total length of 220 mm in a rotational axis direction thereof. Outer diameters of the conductive foamed layer 200 are measured at five locations, where the distance X is 5.0 mm, 57.5 mm, 110.0 mm, 162.5 mm, and 215.0 mm. As described above, the distance X (mm) is defined as the length from a reference position S shown in FIG. 1(*a*) (the left end portion (the end portion on the non-drive transmission side) of the conductive foamed layer 200 of the supplying roller 25) toward the right end portion where the drive gears are disposed (the end portion on the driven side). Further, as described above the three points D1, D2, and D3 are defined such that the point D1 is located at the distance X of 5.0 mm, the point D2 is located at the distance X of 110.0 mm, and the point D3 is located at the distance X of 215.0 mm. The outer diameters of the conductive foamed layer 200 at the points D1, D2, and D3 are defined as ϕD1, ϕD2, and ϕD3.

In the first embodiment, the supplying roller 25 is formed in a shape such that the outer diameters ϕD1, ϕD2, and ϕD3 of the conductive foamed layer 200 at the points D1, D2, and D3 are satisfied a condition of ϕD1>ϕD2>ϕD3 under a condition in which a contact pressure between the developing roller 23 and the supplying roller 25 is less than 0.10 kgf/cm$^2$. It should be noted that the contact pressure is measured with a pressure sensor (a film type pressure distribution measurement system EH-2-0317, a product of Nitta Corporation).

Figure 5:
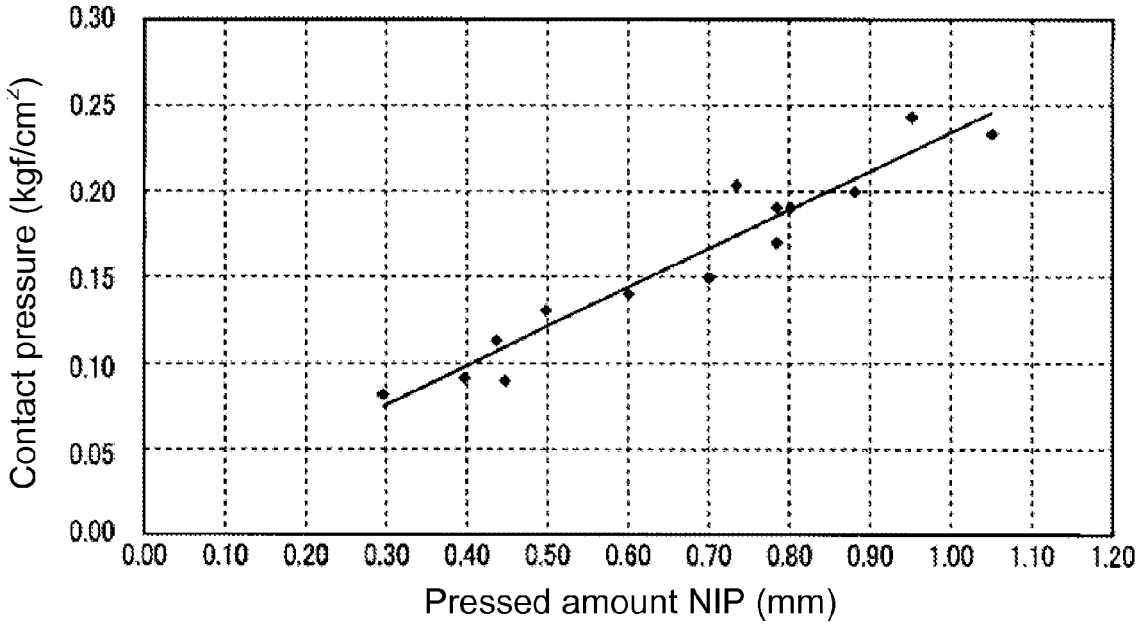
FIG. 5 is a graph showing a relationship between a contact pressure and a pressed amount between the developing roller and the supplying roller of the image forming apparatus according to the first embodiment of the present invention.

FIG. 5 is a graph showing a relationship between the contact pressure and a pressed amount NIP between the developing roller 23 and the supplying roller 25 of the printer 1 as the image forming apparatus according to the first embodiment of the present invention.

As shown in FIG. 5, the contact pressure increases in proportional to the pressed amount NIP between the developing roller 23 and the supplying roller 25 in an inter-axial direction. In FIG. 5, the developing roller 23 and the supplying roller 25 are arranged such that the inter-axial distance in between becomes 12.0 mm. Further, the supplying roller 25 has a straight shape having the outer diameter ϕ of 13.0 mm, and the outer diameter of the developing roller 23 is changed while the pressed amount NIP is being adjusted. The contact pressure is measured as an average value of pressure applied to an entire portion of the developing roller 23 and the supplying roller 25 in the axial direction in which the developing roller 23 contacts with the supplying roller 25.

As described above, in the experiment, the continuous durability print test was conducted using the color printer having one of Sample 1 to Sample 4 of the supplying roller 25 having different shapes. More specifically, Sample 1 had the straight cylindrical shape having the identical outer diameter of ϕD1, ϕD2, and ϕD3. Sample 2 had the outer diameter ϕD3 smaller than the outer diameter ϕD1 by about 0.2 mm. Sample 3 had the outer diameter ϕD3 smaller than the outer diameter ϕD1 by about 0.4 mm. Sample 4 had the outer diameter ϕD3 smaller than the outer diameter ϕD1 by about 0.6 mm.

Figure 7A:
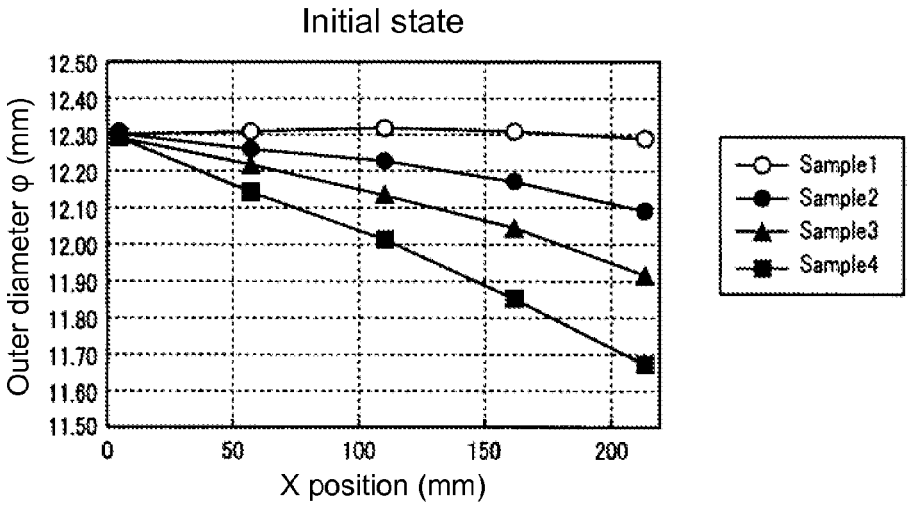
FIGS. 7(*a*) to 7(*c*) are graphs showing an outer diameter profile of the supplying roller of the image forming apparatus according to the first embodiment of the present invention, wherein FIG. 7(*a*) is a graph showing the outer diameter profile of the supplying roller of the image forming apparatus in an initial state, FIG. 7(*b*) is a graph showing the outer diameter profile of the supplying roller of the image forming apparatus after a continuous durability test, and FIG. 7(*c*) is a graph showing a wear amount of the supplying roller of the image forming apparatus after the continuous durability test.
Figure 7B:
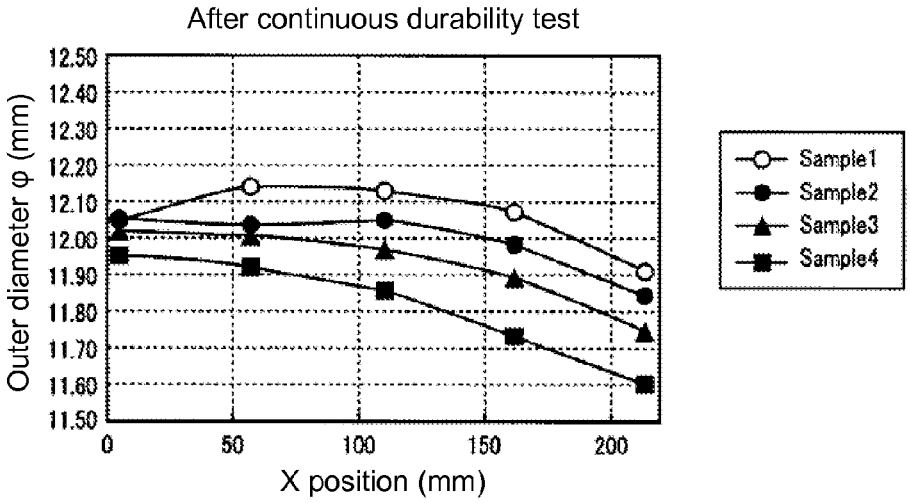
Figure 7C:
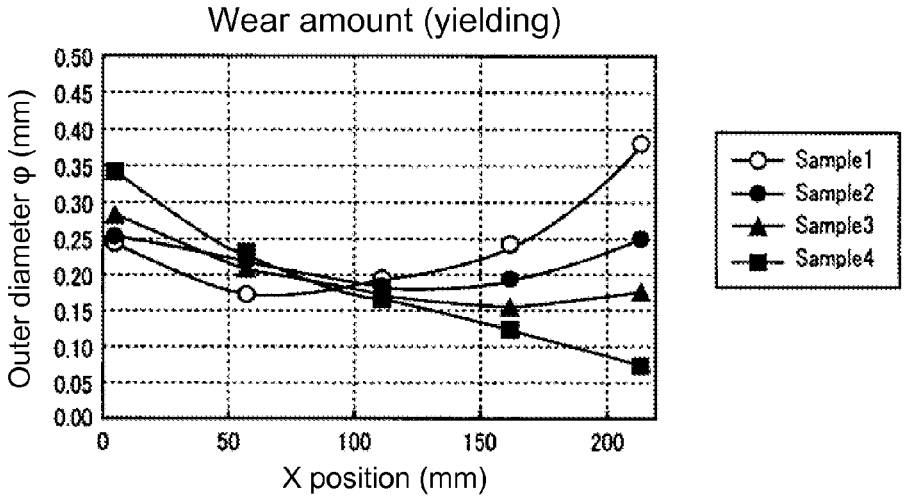

FIGS. 7(*a*) to 7(*c*) are graphs showing the outer diameter profile of the supplying roller 25 of the printer 1 as the image forming apparatus according to the first embodiment of the present invention. More specifically, FIG. 7(*a*) is a graph showing the outer diameter profile of the supplying roller 25 of the color printer as the image forming apparatus in the initial state.

In the continuous durability print test, the color printer had the image forming unit with a life of 20,000 drum count. The color printer was configured such that the drum count increased by one every time the photosensitive drum made on rotation. Further, a letter sheet Hammarmill Laser Print LT241b (a product of International Paper) as an evaluation medium (a sheet).

Figure 12:
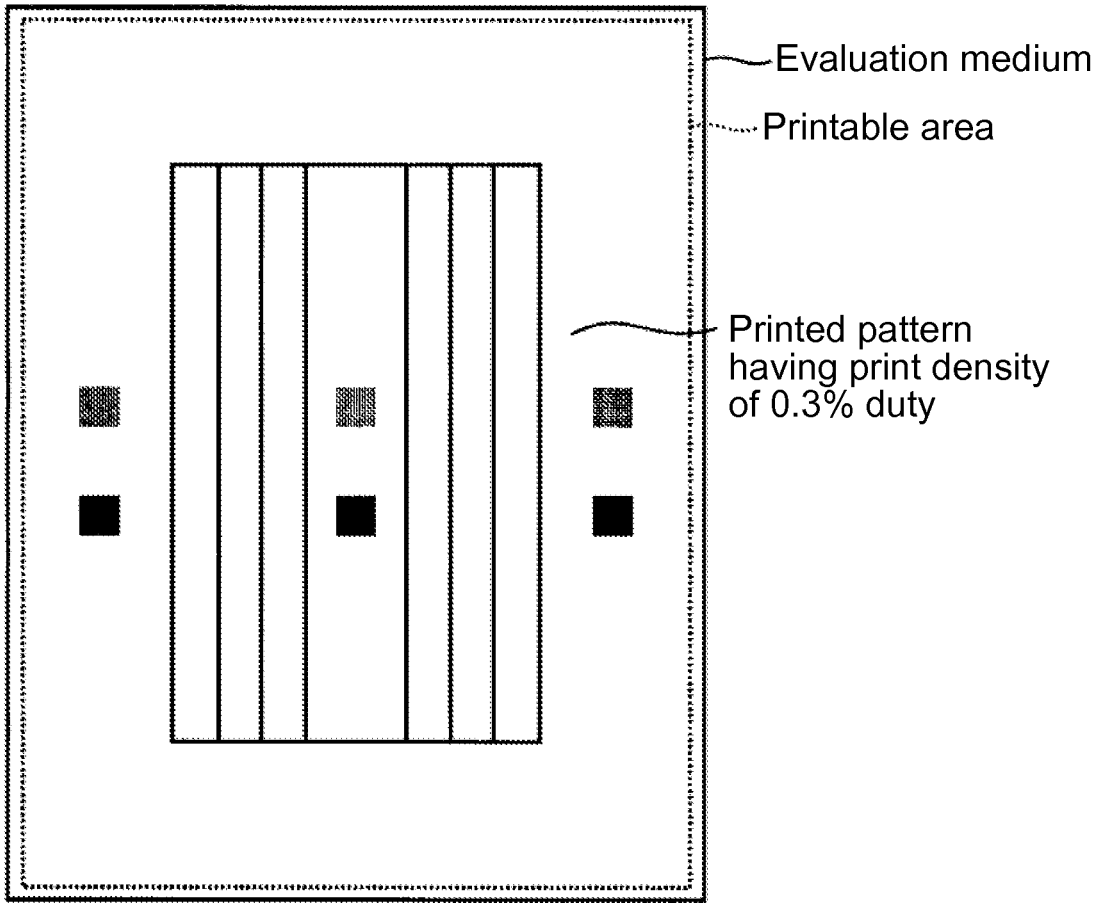
FIG. 12 is a schematic side view showing a printed pattern of the image forming apparatus according to the first embodiment of the present invention.

FIG. 12 is a schematic side view showing a printed pattern of the image forming apparatus according to the first embodiment of the present invention. As shown in FIG. 12, in the continuous durability print test, the printed pattern having a print density of 0.3% duty was printed on every other sheet in a printable area of the evaluation sheet having the letter size in an alternate printing operation until the drum count became 30,000.

FIG. 7(*b*) is a graph showing the outer diameter profile of Sample 1 to Sample 4 of the supplying roller 25 of the color printer as the image forming apparatus after the continuous durability test. Also, the outer diameter profiles of Sample 1 to Sample 4 of the supplying roller 25 after the continuous durability test are shown in Table 2.

TABLE 2

| | Outer diameter ϕ after continuous durability test (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 12.05 | 12.14 | 12.13 | 12.07 | 11.91 |
| Sample 2 | 12.06 | 12.04 | 12.05 | 11.98 | 11.84 |
| Sample 3 | 12.02 | 12.01 | 11.97 | 11.90 | 11.75 |
| Sample 4 | 11.95 | 11.92 | 11.85 | 11.73 | 11.60 |

FIG. 7(*c*) is a graph showing a wear amount of Sample 1 to Sample 4 of the supplying roller 25 of the color printer as the image forming apparatus after the continuous durability test. Also, the wear amounts of Sample 1 to Sample 4 of the supplying roller 25 after the continuous durability test are shown in Table 3. The wear amount (yielding of sponge) is defined as a difference in the outer diameters Sample 1 to Sample 4 of the supplying roller 25 after the continuous durability test. The wear amount (yielding of sponge) will be explained in more detail later.

TABLE 3

| | Wear amount (yielding) after continuous durability test (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 0.24 | 0.17 | 0.19 | 0.24 | 0.38 |
| Sample 2 | 0.25 | 0.22 | 0.18 | 0.19 | 0.25 |
| Sample 3 | 0.28 | 0.21 | 0.17 | 0.16 | 0.18 |
| Sample 4 | 0.34 | 0.22 | 0.16 | 0.12 | 0.07 |

In the continuous durability test, the outer diameters and the wear amount were measured with the contact pressure of 0.08 kgf/cm$^2$.

In the experiment, a print quality test was evaluated after the continuous durability test while the contact pressure was being changed. The results of the print quality test are shown in Table 4. In Table 4, when there was no print quality problem, the result is represented as good. When there was a print quality problem due to a poor initial scraping off, the result is represented as fair. When there was a print quality problem due to the wear (yielding) during the continuous durability test, the result is represented as poor.

TABLE 4

| | Print quality | | | | |
|---|---|---|---|---|---|
| Contact pressure (kgf/cm$^2$) | 0.08 | 0.10 | 0.15 | 0.20 | 0.24 |
| Sample 1 | poor | poor | poor | poor | poor |
| Sample 2 | fair | good | poor | poor | poor |
| Sample 3 | fair | good | good | poor | poor |
| Sample 4 | fair | good | good | poor | poor |

As shown in Table 4, in Sample 1, a stain (the print quality problem) occurred at the point D3 on the driven side of the supplying roller 25 within the entire range of the contact pressure between 0.08 kgf/cm$^2$ and 0.24 kgf/cm$^2$. As described above, Sample 1 had the straight shape with the outer diameter $\phi$ of 12.3 mm over the entire length thereof in the rotational axis direction. Accordingly, it was supposed that the outer diameter should uniformly be worn over the entire length thereof in the rotational axis direction after the continuous durability test. However, according to the results of the experiment, the wear amount (yielding) became most excessive at the point D3 on the driven side of the supplying roller 25, and the wear amount (yielding) was less excessive at the point D1 on the non-driven side of the supplying roller 25. Accordingly, it is concluded that the contact pressure between the developing roller 23 and the supplying roller 25 on the driven side of the supplying roller 25 was greater than that on the non-drive side of the supplying roller 25 for the reasons explained below.

As described above with reference to FIG. 4, the developing roller 23 is arranged to rotate while abutting against the supplying roller 25. Further, bearing receiving portions at the both end portions of the developing roller 23 and the supplying roller 25 are tightly fitted in a developing device bearing portion (not shown), so that the shafts of the developing roller 23 and the supplying roller 25 are fixed. However, due to a general dimensional variance of the bearing receiving portions and the device bearing portion, there is a gap between the bearing receiving portions and the device bearing portion in a direction that an external force is alleviated. In the printer 1, when the drive force is transmitted through the photosensitive drum gear 304, the toner 305, the drive transmission gear 302, and the supplying roller gear 301 engaged with each other, a reaction force proportional to a load torque is applied in a direction perpendicular to a pressing angle direction of a teeth engagement portion of the gears on the drive side and the gears on the driven side. Further, the load torque necessary for rotating each roller tends to decrease with being away from the photosensitive drum 21.

In the gear arrangement shown in FIG. 4(*b*), a sum of the reaction forces applied to the developing roller gear 303 and the supplying roller gear 301 is applied in a direction of pressing the supplying roller 25 against the developing roller 23. Accordingly, the force of pressing the supplying roller 25 against the developing roller 23 tends to be greater on the drive side than the driven side. Further, a wobble of the drive gear or a twist of the developing device 2 in the loading direction on the driven side enlarges the force of pressing the supplying roller 25 against the developing roller 23.

Further, at this moment, the shaft 202 of the supplying roller 25 is deformed in the direction opposite to the contacting direction of the developing roller 23, so that the wear amount (yielding) became small at the point D2 at the center of the supplying roller 25. In other words, the supplying roller 25 is pressed against the developing roller 23 with a relatively small force, so that the wear amount (yielding) became small.

In the experiment, with regard to Sample 1, the wear amount (yielding) exhibited the maximum level of 0.38 mm at the point D3 on the driven side, so that the stain occurred at the point D3, thereby lowering the print quality. It should be noted that the stain due to the wear (yielding) tends to occur when the wear amount (yielding) exceeds 0.30 mm. Accordingly, the stain did not occur at the point D1 or the pint D2.

In the experiment, with regard to Sample 2, the load on the supplying roller 25 on the driven side was reduced, so that it was possible to perform the printing operation without the print quality problem at the contact pressure of 0.08 kg/cm$^2$ until the drum count became 30,000. Further, the wear amount (yielding) exhibited less than 0.30 mm at all of the points D1 to D4. Accordingly, as compared to Sample 1, Sample 2 of the supplying roller 25 worn uniformly. However, when the contact pressure became greater than 0.10 kg/cm$^2$, the wear amount (yielding) increased, thereby causing the stain.

In the experiment, with regard to Sample 3, similar to Sample 2, it was possible to perform the printing operation without the print quality problem at the contact pressure of 0.08 kg/cm$^2$ until the drum count became 30,000. Further, the wear amount (yielding) exhibited less than 0.30 mm at all of the points D1 to D4. Accordingly, as compared to Sample 1, Sample 3 of the supplying roller 25 worn uniformly. However, when the contact pressure became greater than 0.10 kg/cm$^2$, the wear amount (yielding) increased on the non-driven side, thereby causing the stain.

In the experiment, with regard to Sample 4, it was not possible to perform the printing operation without the print quality problem even at the contact pressure of 0.08 kg/cm$^2$. In Sample 4, the diameter difference was large on the pint D1 and the point D3. Accordingly, the pressure on the point D1 on the non-driven side became excessive, so that the wear amount became 0.34 mm, thereby causing the stain. On the other hand, the pressure on the point D3 on the driven side became insufficient, so that the scraping off did not appear to be sufficient from the initial state, thereby causing the stain.

In the first embodiment, as described above, the supplying roller 25 is formed in the shape such that the outer diameters ϕD1, ϕD2, and ϕD3 of the conductive foamed layer 200 at the points D1, D2, and D3 satisfy the condition of ϕD1>ϕD2>ϕD3 under the condition in which the contact pressure between the developing roller 23 and the supplying roller 25 is less than 0.10 kgf/cm$^2$. Accordingly, it is possible to reduce the wear amount (yielding) due to the excessive pressure on the driven side. As a result, it is possible to reduce the stain due to the wear (yielding) of the supplying roller 25 up to 1.5 times of the life of the image forming unit 20, and to obtain an image with good quality. It should be noted that the wear amount (yielding) of the supplying roller 25 increases in proportional to the print sheet number in the continuous durability print test. Accordingly, when the supplying roller 25 is formed in the shape as defined in the first embodiment, it is possible to perform the continuous printing operation longer than the case that the supplying roller 25 is formed in the straight shape.

In the first embodiment, when the condition of ϕD1>ϕD2>ϕD3 is satisfied, it is preferred that the difference between ϕD1 and ϕD2 is between 0.1 mm and 0.2 mm, and the difference between ϕD2 and ϕD3 is between 0.1 mm and 0.2 mm. It should be noted that the difference between ϕD1 and ϕD2 and the difference between ϕD2 and ϕD3 are variable according to the arrangement of the photosensitive drum gear 304, the developing roller gear 303, the drive transmission gear 302, and the supplying roller gear 301, and the load torque of each roller. Accordingly, it is preferable that the difference between ϕD1 and ϕD2 and the difference between ϕD2 and ϕD3 are determined through an experiment.

Figure 13A:
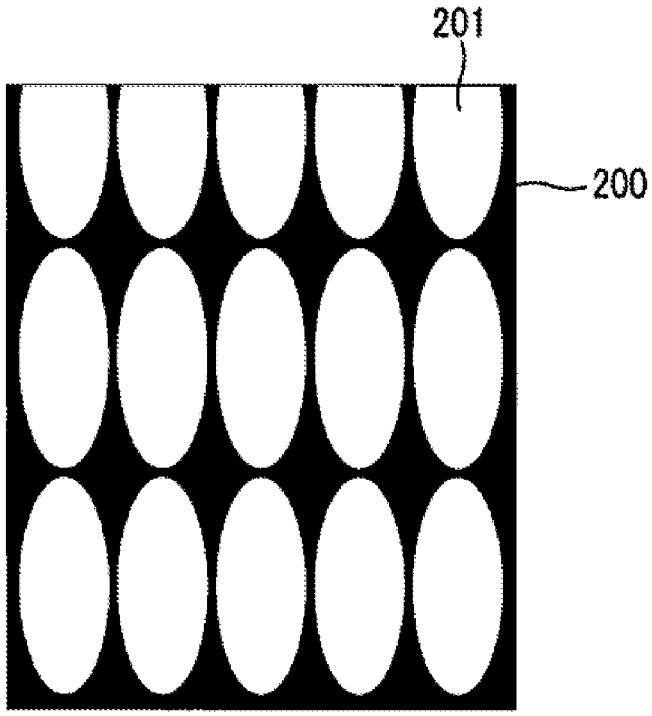
FIGS. 13(*a*) and 13(*b*) are schematic sectional views showing the conductive foamed layer of the supplying roller of the image forming apparatus according to the first embodiment of the present invention, wherein FIG. 13(*a*) is a schematic sectional view showing the conductive foamed layer of the supplying roller of the image forming apparatus in the initial state, and FIG. 13(*b*) is a schematic sectional view showing the conductive foamed layer of the supplying roller of the image forming apparatus after the continuous durability test.
Figure 13B:
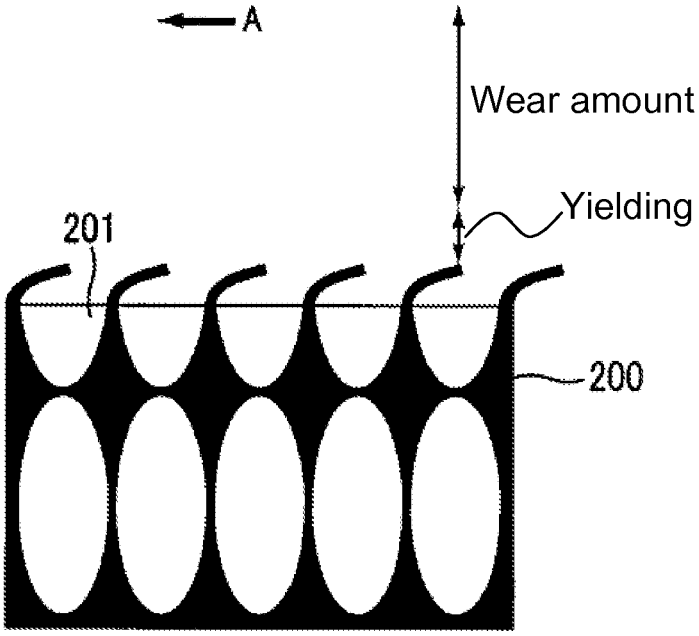

Next, the wear (yielding) of the supplying roller 25 will be explained in more detail with reference to FIGS. 13(*a*) and 13(*b*). FIGS. 13(*a*) and 13(*b*) are schematic sectional views showing the conductive foamed layer 200 of the supplying roller 25 of the printer 1 as the image forming apparatus according to the first embodiment of the present invention. More specifically, FIG. 13(*a*) is a schematic sectional view showing the conductive foamed layer 200 of the supplying roller 25 of the printer 1 as the image forming apparatus in the initial state, and FIG. 13(*b*) is a schematic sectional view showing the conductive foamed layer 200 of the supplying roller 25 of the printer 1 as the image forming apparatus after the continuous durability test.

As shown in FIG. 13(*a*), in the conductive foamed layer 200 of the supplying roller 25 in the initial state, all walls of the cells 201 stand straight. Accordingly, opening portions are formed in the surface of the conductive foamed layer 200, so that it is possible to stably supply toner retained in the cells 201 to the developing roller 23. Further, it is possible to stably scrape off excess toner on the developing roller 23.

On the other hand, as shown in FIG. 13(*b*), in the conductive foamed layer 200 of the supplying roller 25 after the continuous durability test, the conductive foamed layer 200 is worn out and the walls of the cells 201 are deformed in an arrow direction A toward an upstream side in the rotation direction of the supplying roller 25, thereby causing the yielding. When the walls of the cells 201 are deformed, it is difficult to supply a sufficient amount of toner to the developing roller 23. Further, it is difficult to securely scrape off excess toner on the developing roller 23. Generally speaking, it is possible to increase an amount of toner supplied to the developing roller 23 through increasing the bias voltage applied to the supplying roller 25. However, in this case, an amount of excess toner on the developing roller 23 also increases, thereby causing the stain due to insufficient scraping off.

As explained above, in the first embodiment, the supplying roller 25 is formed in the shape such that the outer diameters ϕD1, ϕD2, and ϕD3 of the conductive foamed layer 200 at the points D1, D2, and D3 satisfy the condition of ϕD1>ϕD2>ϕD3 under the condition in which the contact pressure between the developing roller 23 and the supplying roller 25 is less than 0.10 kgf/cm$^2$. The point D1 is located at the position 5.0 mm away from the end portion on the non-drive transmission side of the conductive foamed layer 200 of the supplying roller 25 toward the opposite end portion on the driven side. Similarly, the point D2 is located at the position away from the end portion by 110.0 mm, and the point D3 is located at the position away from the end portion by 215.0 mm. Further, it is preferred that the difference between ϕD1 and ϕD2 is between 0.1 mm and 0.2 mm, and the difference between ϕD2 and ϕD3 is between 0.1 mm and 0.2 mm. Accordingly, it is possible to prolong the life of the image forming unit 20, and to obtain an image with good quality.

Second Embodiment

A second embodiment of the present invention will be explained next. In the second embodiment, the printer 1 as the image forming apparatus includes a supplying roller 25*b* having a shape different from that of the supplying roller 25 in the first embodiment. In the second embodiment, the printer 1 as the image forming apparatus, the image forming unit 20, and the exposure unit 5 have configurations similar to those in the first embodiment except the supplying roller 25. Accordingly, a similar component is designated with the same reference numeral, and an explanation thereof is omitted.

Figure 8:
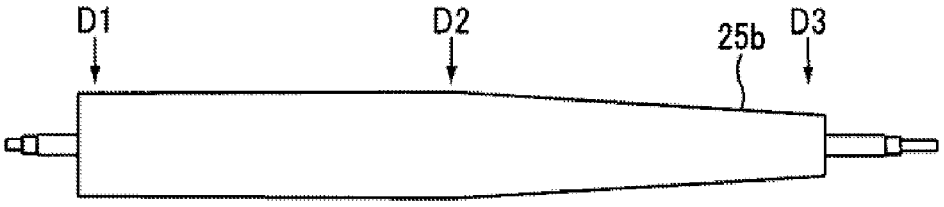
FIG. 8 is a schematic side view showing a supplying roller of an image forming apparatus according to a second embodiment of the present invention.

FIG. 8 is a schematic side view showing the supplying roller 25*b* of the printer 1 as the image forming apparatus according to the second embodiment of the present invention.

As shown in FIG. 8, the supplying roller 25*b* has an outer diameter ϕD1 at the point D1 is substantially the same as an outer diameter ϕD2 at the point D2, and an outer diameter ϕD3 at the point D3 is the smallest. Further, the supplying roller 25*b* is configured such that the outer circumferential surface thereof becomes smooth along a continuous straight line or a curved line between the points D1, D2, and D3 obtained through a conventional polishing method. Alternatively, the supplying roller 25 is configured such that the outer circumferential surface thereof becomes stepwise.

An experiment of evaluating the continuous durability of the supplying roller 25*b* will be explained next. In the experiment, the continuous durability print test was conducted using Sample 1 and Sample 5 to Sample 7 having different shapes. More specifically, Sample 1 had a straight cylindrical shape having an identical outer diameter of ϕD1, ϕD2, and ϕD3. Sample 5 had the outer diameter ϕD3 smaller than the outer diameter ϕD1 and the outer diameter ϕD2 by about 0.2 mm. Sample 6 had the outer diameter ϕD3 smaller than the outer diameter ϕD1 and the outer diameter ϕD2 by about 0.4 mm. Sample 7 had the outer diameter ϕD3 smaller than the outer diameter ϕD1 and the outer diameter ϕD2 by about 0.6 mm. The outer diameter profiles of Sample 1 and Sample 5 to Sample 7 of the supplying roller 25*b* in the initial state are shown in Table 5.

TABLE 5

| | Outer diameter ϕ in initial state (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 12.29 | 12.32 | 12.32 | 12.32 | 12.27 |
| Sample 5 | 12.33 | 12.36 | 12.35 | 12.28 | 12.10 |

TABLE 5-continued

| Point | Outer diameter ϕ in initial state (mm) D1 | | D2 | | D3 |
|---|---|---|---|---|---|
| Sample 6 | 12.31 | 12.32 | 12.29 | 12.15 | 11.85 |
| Sample 7 | 12.31 | 12.33 | 12.26 | 12.09 | 11.72 |

An effect of the configuration described above will be explained with reference to FIGS. 1, 4, 8, and 9(*a*) to 9(*c*). It should be noted that an operation of the printer 1 as the image forming apparatus, an operation of the image forming unit 20, and an operation of the exposure unit 5 are similar to those in the first embodiment, and explanations thereof are omitted. Further, the configuration of the supplying roller 25*b* except the shape thereof, and the continuous durability print test are similar to those in the first embodiment, and explanations thereof are omitted.

In the second embodiment, the supplying roller 25*b* is formed in the shape such that the outer diameters ϕD1, ϕD2, and ϕD3 at the points D1, D2, and D3 satisfy the condition of ϕD1≈ϕD2>ϕD3 under the condition in which the contact pressure between the developing roller 23 and the supplying roller 25*b* is equal to or greater than 0.10 kgf/cm$^2$, or equal to or smaller than 0.15 kgf/cm$^2$. The outer diameters ϕD1 and ϕD2 may have a manufacturing variance of about ±0.05 mm. Further, it is preferred that the difference between the outer diameters ϕD2 and ϕD3 is between 0.4 mm and 0.6 mm.

Figure 9A:
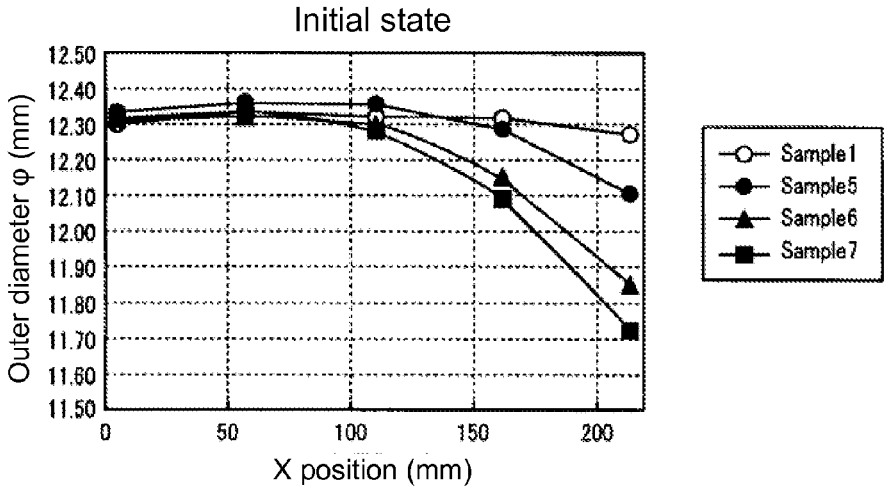
FIGS. 9(*a*) to 9(*c*) are graphs showing an outer diameter profile of the supplying roller of the image forming apparatus according to the second embodiment of the present invention, wherein FIG. 9(*a*) is a graph showing the outer diameter profile of the supplying roller of the image forming apparatus in the initial state, FIG. 9(*b*) is a graph showing the outer diameter profile of the supplying roller of the image forming apparatus after the continuous durability test, and FIG. 9(*c*) is a graph showing a wear amount of the supplying roller of the image forming apparatus after the continuous durability test.
Figure 9B:
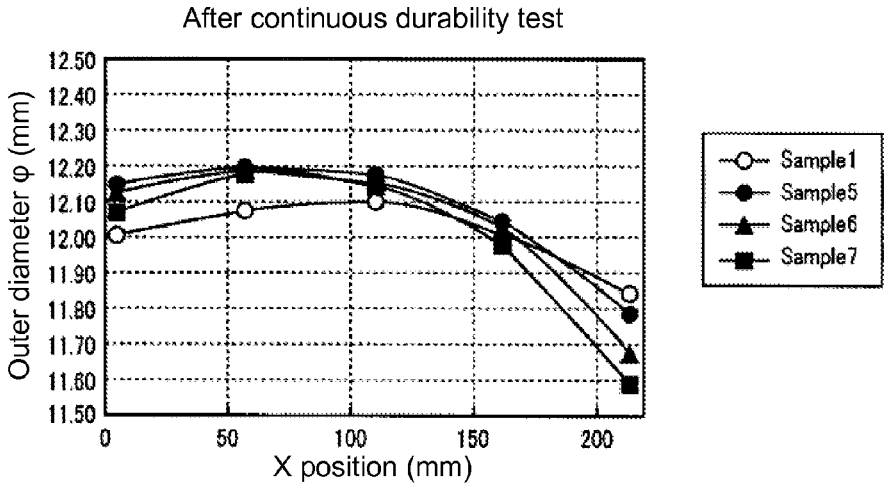
Figure 9C:
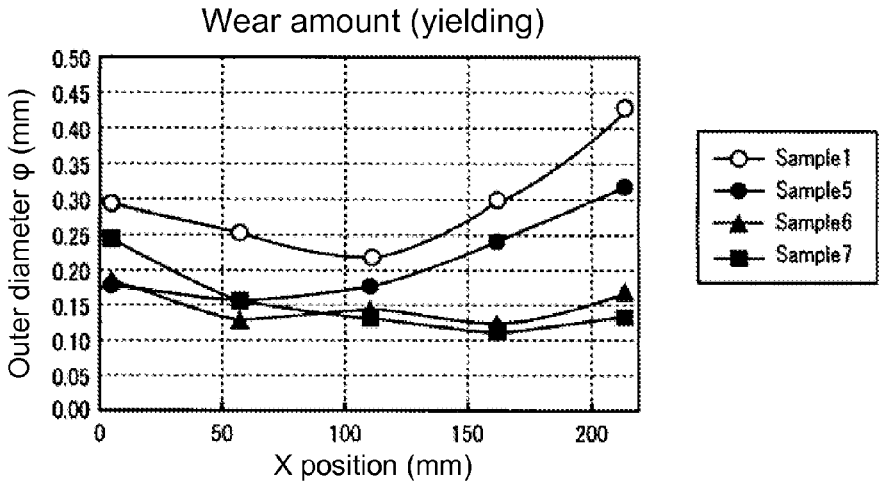

FIGS. 9(*a*) to 9(*c*) are graphs showing an outer diameter profile of the supplying roller 25*b* of the printer 1 as the image forming apparatus according to the second embodiment of the present invention. More specifically, FIG. 9(*a*) is a graph showing the outer diameter profile of the supplying roller 25*b* of the printer 1 as the image forming apparatus in the initial state. Also, the outer diameter profiles of Sample 1 and Sample 5 to Sample 7 of the supplying roller 25*b* in the initial state are shown in Table 5.

Further, FIG. 9(*b*) is a graph showing the outer diameter profile of the supplying roller 25*b* of the printer 1 as the image forming apparatus after the continuous durability test. Also, the outer diameter profiles of Sample 1 and Sample 5 to Sample 7 of the supplying roller 25*b* after the continuous durability test are shown in Table 6.

TABLE 6

| Point | Outer diameter ϕ after continuous durability test (mm) D1 | | D2 | | D3 |
|---|---|---|---|---|---|
| X position (mm) | 5.0 | 57.5 | 110.0 | 162.5 | 215.0 |
| Sample 1 | 12.00 | 12.07 | 12.10 | 12.02 | 11.84 |
| Sample 5 | 12.15 | 12.20 | 12.18 | 12.04 | 11.78 |
| Sample 6 | 12.13 | 12.19 | 12.15 | 12.03 | 11.68 |
| Sample 7 | 12.07 | 12.18 | 12.15 | 11.98 | 11.59 |

Further, FIG. 9(*c*) is a graph showing the wear amount of the supplying roller 25*b* of the printer 1 as the image forming apparatus after the continuous durability test. Also, the wear amounts of Sample 1 and Sample 5 to Sample 7 of the supplying roller 25*b* after the continuous durability test are shown in Table 7. Similar to the first embodiment, the wear amount (yielding of sponge) is defined as a difference in the outer diameters Sample 1 and Sample 5 to Sample 7 of the supplying roller 25*b* after the continuous durability test.

TABLE 7

| Point | Wear amount (yielding) after continuous durability test (mm) D1 | | D2 | | D3 |
|---|---|---|---|---|---|
| X position (mm) | 5.0 | 57.5 | 110.0 | 162.5 | 215.0 |
| Sample 1 | 0.29 | 0.25 | 0.22 | 0.30 | 0.43 |
| Sample 5 | 0.18 | 0.16 | 0.17 | 0.24 | 0.32 |
| Sample 6 | 0.18 | 0.13 | 0.14 | 0.12 | 0.17 |
| Sample 7 | 0.24 | 0.15 | 0.13 | 0.11 | 0.13 |

In the continuous durability test, the outer diameters and the wear amount were measured with the contact pressure of 0.15 kgf/cm$^2$.

In the experiment, the print quality test was evaluated after the continuous durability test while the contact pressure was being changed. The results of the print quality test are shown in Table 8. In Table 8, when there was no print quality problem, the result is represented as good. When there was a print quality problem due to the poor initial scraping off, the result is represented as fair. When there was a print quality problem due to the wear (yielding) during the continuous durability test, the result is represented as poor.

TABLE 8

| Contact pressure (kgf/cm$^2$) | Print quality 0.08 | 0.10 | 0.15 | 0.20 | 0.24 |
|---|---|---|---|---|---|
| Sample 1 | poor | poor | poor | poor | poor |
| Sample 5 | fair | good | poor | poor | poor |
| Sample 6 | fair | good | good | poor | poor |
| Sample 7 | fair | good | good | poor | poor |

As shown in Table 8, with regard to Sample 1, the stain (the print quality problem) occurred due to the yielding at the point D3 on the driven side of the supplying roller 25*b* over the entire range of the contact pressure between 0.08 kgf/cm$^2$ and 0.24 kgf/cm$^2$. As shown in Table 7, as compared with the first embodiment, the wear amount (yielding) became worse at the point D3 by about 25% due to the greater contact pressure than that in the first embodiment.

In the experiment, when the supplying roller 25*b* has the shape of Sample 5, and the load on the supplying roller 25*b* on the driven side was reduced, it was possible to perform the printing operation without the print quality problem at the contact pressure of 0.10 kg/cm$^2$ until the drum count became 30,000. However, when the contact pressure became greater than 0.10 kg/cm$^2$, the stain occurred on the driven side due to the yielding.

Further, with regard to Sample 5, when the contact pressure became 0.15 kg/cm$^2$, the wear amount (yielding) became 0.32 mm exceeding the threshold value of 0.30 mm at the point D3. Accordingly, as compared with Sample 6 and Sample 7, the wear amount (yielding) became greater. Further, when the supplying roller 25*b* has the shape of Sample 5, due to the large difference between the outer diameter ϕD2 and the outer diameter ϕD3, the stain occurred due to the insufficient scraping off from the initial state at the contact pressure less than 0.15 kg/cm$^2$.

In the experiment, when the supplying roller 25*b* has the shape of Sample 6, and the load on the supplying roller 25*b* on the driven side was reduced, it was possible to perform the printing operation without the print quality problem at the contact pressure between 0.10 kg/cm$^2$ and 0.15 kg/cm$^2$ until the drum count became 30,000. However, when the contact pressure became greater than 0.15 kg/cm$^2$, the stain occurred on the driven side due to the yielding. When the contact pressure became 0.15 kg/cm$^2$, the wear amount (yielding) at the point D3 became smaller than that of Sample 1 and Sample 5, and the wear amount (yielding) became less than 0.30 mm at all of the points D1 to D3, thereby achieving the good result. When the contact pressure became less than 0.10 kg/cm$^2$, similar to Sample 5, the stain occurred due to the insufficient scraping off from the initial state.

In the experiment, with regard to Sample 7, the results were similar to Sample 6. Further, due to the large difference between the outer diameter ϕD2 and the outer diameter ϕD3, the wear amount (yielding) became relatively large on the non-driven side. That is, when the contact pressure became 0.15 kg/cm$^2$, the shape of Sample 6 exhibited most favorable results.

In the second embodiment, as described above, the supplying roller 25*b* is formed in the shape such that the outer diameters ϕD1, ϕD2, and ϕD3 of the conductive foamed layer 200 at the points D1, D2, and D3 satisfy the condition of ϕD1≈ϕD2>ϕD3 under the condition in which the contact pressure between the developing roller 23 and the supplying roller 25*b* is equal to or greater than 0.10 kgf/cm$^2$, or equal to or smaller than 0.15 kgf/cm$^2$. Accordingly, it is possible to reduce the wear amount (yielding) due to the excessive pressure on the driven side. As a result, it is possible to reduce the stain due to the yielding of the supplying roller 25*b* up to 1.5 times of the life of the image forming unit 20, and to obtain an image with good quality. It should be noted that the difference between ϕD1 and ϕD2 and the difference between ϕD2 and ϕD3 are variable according to the arrangement of the photosensitive drum gear 304, the developing roller gear 303, the drive transmission gear 302, and the supplying roller gear 301, and the load torque of each roller. Accordingly, it is preferable that the difference between ϕD1 and ϕD2 and the difference between ϕD2 and ϕD3 are determined through an experiment.

As explained above, in the second embodiment, the supplying roller 25*b* is formed in the shape such that the outer diameters ϕD1, ϕD2, and ϕD3 of the conductive foamed layer 200 at the points D1, D2, and D3 satisfy the condition of ϕD1≈ϕD2>ϕD3 under the condition in which the contact pressure between the developing roller 23 and the supplying roller 25*b* is equal to or greater than 0.10 kgf/cm$^2$, or equal to or smaller than 0.15 kgf/cm$^2$. The point D1 is located at the position 5.0 mm away from the end portion on the non-drive transmission side of the conductive foamed layer 200 of the supplying roller 25*b* toward the opposite end portion on the driven side. Similarly, the point D2 is located at the position away from the end portion by 110.0 mm, and the point D3 is located at the position away from the end portion by 215.0 mm. Further, it is preferred that the difference between ϕD1 and ϕD2 is ±0.05 mm. Accordingly, it is possible to prolong the life of the image forming unit 20, and to obtain an image with good quality.

Third Embodiment

A third embodiment of the present invention will be explained next. In the third embodiment, the printer 1 as the image forming apparatus includes a supplying roller 25*c* having a shape different from that of the supplying roller 25 in the first embodiment and that of the supplying roller 25*b* in the second embodiment. In the third embodiment, the printer 1 as the image forming apparatus, the image forming unit 20, and the exposure unit 5 have configurations similar to those in the first embodiment except the supplying roller 25 and those in the second embodiment except the supplying roller 25*b*. Accordingly, a similar component is designated with the same reference numeral, and an explanation thereof is omitted.

Figure 10:
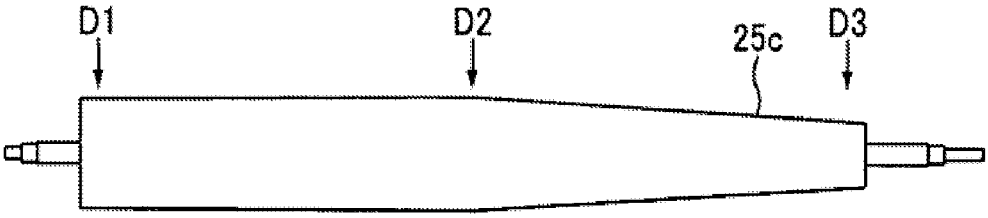
FIG. 10 is a schematic side view showing a supplying roller of an image forming apparatus according to a third embodiment of the present invention.

FIG. 10 is a schematic side view showing the supplying roller 25*c* of the printer 1 as the image forming apparatus according to the third embodiment of the present invention.

As shown in FIG. 10, the supplying roller 25*c* has a largest outer diameter ϕD2 at the point D2. Further, the supplying roller 25*c* has an outer diameter ϕD1 at the point D1 smaller than the outer diameter ϕD2, and an outer diameter ϕD3 thereof at the point D3 is the smallest. Further, the supplying roller 25*b* is configured such that the outer circumferential surface thereof becomes smooth along a continuous straight line or a curved line between the points D1, D2, and D3 obtained through a conventional polishing method. Alternatively, the supplying roller 25 is configured such that the outer circumferential surface thereof becomes stepwise.

An experiment of evaluating the continuous durability of the supplying roller 25*c* will be explained next. In the experiment, the continuous durability print test was conducted using Sample 1 and Sample 8 to Sample 10 having different shapes. More specifically, Sample 1 had a straight cylindrical shape having an identical outer diameter of ϕD1, ϕD2, and ϕD3. Sample 8 had the outer diameter ϕD1 smaller than the outer diameter ϕD2 by about 0.1 mm, and the outer diameter ϕD3 smaller than the outer diameter ϕD2 by about 0.4 mm. Sample 9 had the outer diameter ϕD1 smaller than the outer diameter ϕD2 by about 0.2 mm, and the outer diameter ϕD3 smaller than the outer diameter ϕD2 by about 0.4 mm. Sample 10 had the outer diameter ϕD1 smaller than the outer diameter ϕD2 by about 0.3 mm, and the outer diameter ϕD3 smaller than the outer diameter ϕD2 by about 0.5 mm. The outer diameter profiles of Sample 1 and Sample 8 to Sample 10 of the supplying roller 25*c* in the initial state are shown in Table 9.

TABLE 9

| | Outer diameter ϕ in initial state (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 12.30 | 12.33 | 12.31 | 12.33 | 12.29 |
| Sample 8 | 12.20 | 12.27 | 12.31 | 12.14 | 11.91 |
| Sample 9 | 12.11 | 12.24 | 12.33 | 12.13 | 11.89 |
| Sample 10 | 12.02 | 12.20 | 12.32 | 12.10 | 11.86 |

An effect of the configuration described above will be explained with reference to FIGS. 1, 4, 10, and 11(*a*) to 11(*c*). It should be noted that an operation of the printer 1 as the image forming apparatus, an operation of the image forming unit 20, and an operation of the exposure unit 5 are similar to those in the first embodiment and the second embodiment, and explanations thereof are omitted. Further, the configuration of the supplying roller 25*c* except the shape thereof, and the continuous durability print test are similar to those in the first embodiment and the second embodiment, and explanations thereof are omitted.

In the third embodiment, the supplying roller 25*c* is formed in the shape such that the outer diameters ϕD1, ϕD2, and ϕD3 at the points D1, D2, and D3 satisfy the condition of ϕD2>ϕD1>ϕD3 under the condition in which the contact pressure between the developing roller 23 and the supplying roller 25*b* is equal to or greater than 0.15 kgf/cm$^2$, or equal to or smaller than 0.20 kgf/cm$^2$. It is preferable that the difference between the outer diameters ϕD1 and ϕD2 between 0.1 mm and 0.3 mm, and the difference between the outer diameters ϕD2 and ϕD3 is between 0.4 mm and 0.6 mm.

Figure 11A:
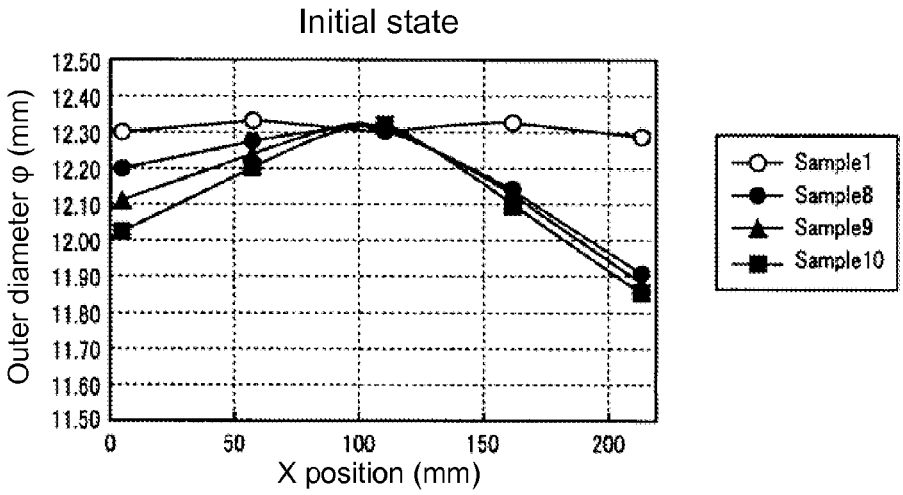
FIGS. 11(*a*) to 11(*c*) are graphs showing an outer diameter profile of the supplying roller of the image forming apparatus according to the third embodiment of the present invention, wherein FIG. 11(*a*) is a graph showing the outer diameter profile of the supplying roller of the image forming apparatus in the initial state, FIG. 11(*b*) is a graph showing the outer diameter profile of the supplying roller of the image forming apparatus after the continuous durability test, and FIG. 11(*c*) is a graph showing a wear amount of the supplying roller of the image forming apparatus after the continuous durability test.
Figure 11B:
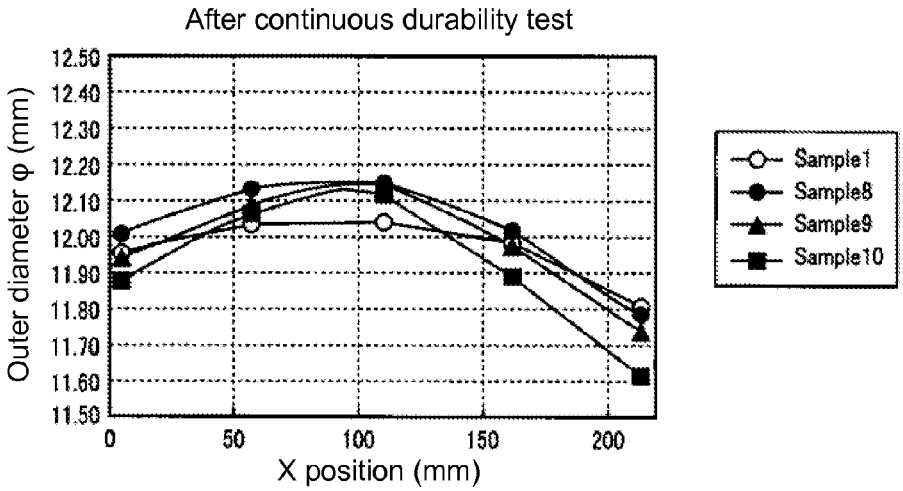
Figure 11C:
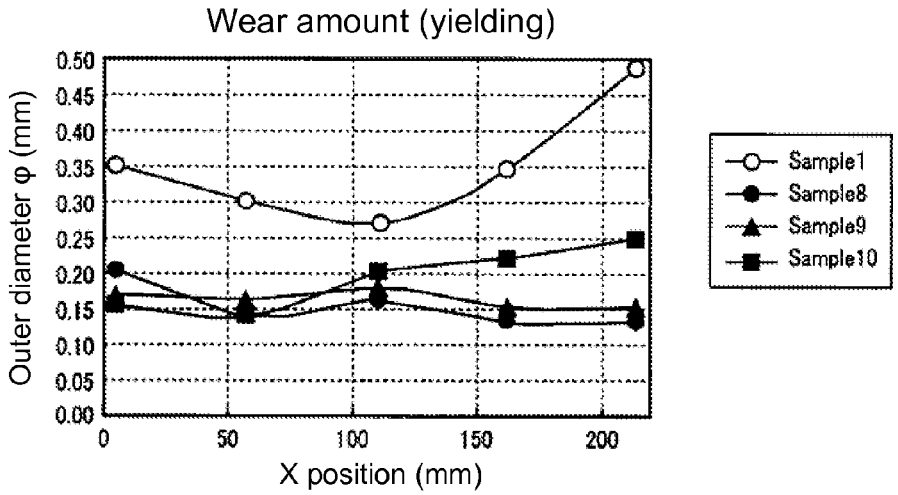

FIGS. 11(*a*) to 11(*c*) are graphs showing an outer diameter profile of the supplying roller 25*c* of the printer 1 as the image forming apparatus according to the third embodiment of the present invention. More specifically, FIG. 11(*a*) is a graph showing the outer diameter profile of the supplying roller 25*c* of the printer 1 as the image forming apparatus in the initial state. Also, the outer diameter profiles of Sample 1 and Sample 8 to Sample 10 of the supplying roller 25*c* in the initial state are shown in Table 9.

Further, FIG. 11(*b*) is a graph showing the outer diameter profile of the supplying roller 25*c* of the printer 1 as the image forming apparatus after the continuous durability test. Also, the outer diameter profiles of Sample 1 and Sample 8 to Sample 10 of the supplying roller 25*c* after the continuous durability test are shown in Table 10.

TABLE 10

| | Outer diameter ϕ after continuous durability test (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 11.95 | 12.03 | 12.04 | 11.98 | 11.81 |
| Sample 8 | 12.00 | 12.13 | 12.15 | 12.01 | 11.78 |
| Sample 9 | 11.94 | 12.08 | 12.15 | 11.98 | 11.74 |
| Sample 10 | 11.87 | 12.06 | 12.12 | 11.88 | 11.61 |

Further, FIG. 11(*c*) is a graph showing the wear amount of the supplying roller 25*c* of the printer 1 as the image forming apparatus after the continuous durability test. Also, the wear amounts of Sample 1 and Sample 8 to Sample 10 of the supplying roller 25*c* after the continuous durability test are shown in Table 11. Similar to the first embodiment and the second embodiment, the wear amount (yielding of sponge) is defined as a difference in the outer diameters Sample 1 and Sample 8 to Sample 10 of the supplying roller 25*c* after the continuous durability test.

TABLE 11

| | Wear amount (yielding) after continuous durability test (mm) | | | | |
|---|---|---|---|---|---|
| Point | D1 | | D2 | | D3 |
| X position (mm) | 5.0 | 57.5 | 110.0 | 162.5 | 215.0 |
| Sample 1 | 0.35 | 0.30 | 0.27 | 0.35 | 0.49 |
| Sample 8 | 0.20 | 0.14 | 0.16 | 0.13 | 0.13 |
| Sample 9 | 0.17 | 0.16 | 0.18 | 0.15 | 0.15 |
| Sample 10 | 0.15 | 0.14 | 0.20 | 0.22 | 0.25 |

In the continuous durability test, the outer diameters and the wear amount were measured with the contact pressure of 0.20 kgf/cm$^2$.

In the experiment, the print quality test was evaluated after the continuous durability test while the contact pressure was being changed. The results of the print quality test are shown in Table 12. In Table 12, when there was no print quality problem, the result is represented as good. When there was a print quality problem due to the poor initial scraping off, the result is represented as fair. When there was a print quality problem due to the wear (yielding) during the continuous durability test, the result is represented as poor.

TABLE 12

| | Print quality | | | | |
|---|---|---|---|---|---|
| Contact pressure (kgf/cm$^2$) | 0.08 | 0.10 | 0.15 | 0.20 | 0.24 |
| Sample 1 | poor | poor | poor | poor | poor |
| Sample 8 | fair | fair | good | good | good |
| Sample 9 | fair | fair | good | good | good |
| Sample 10 | fair | fair | good | good | poor |

As shown in Table 12, with regard to Sample 1, the stain occurred due to the yielding at the point D3 on the driven side of the supplying roller 25*c* over the entire range of the contact pressure between 0.08 kgf/cm$^2$ and 0.24 kgf/cm$^2$. Further, the stain occurred due to the yielding at the point D1 on the non-driven side of the supplying roller 25*c*. As compared with the first embodiment and the second embodiment, the wear amount (yielding) became worse by about 35% due to the greater contact pressure than that in the first embodiment and the second embodiment.

In the experiment, when the supplying roller 25*c* has the shape of Sample 8, and the load on the supplying roller 25*c* on the driven side was reduced, it was possible to perform the printing operation without the print quality problem at the contact pressure in the range between 0.15 kg/cm$^2$ and 0.24 kg/cm$^2$ until the drum count became 30,000. However, when the contact pressure became smaller than 0.15 kg/cm$^2$, the stain occurred on the driven side due to the insufficient scraping off in the initial state.

In the experiment, when the supplying roller 25*c* has the shape of Sample 9, the results were similar to those of Sample 8. More specifically, the wear amount (yielding) of the supplying roller 25*c* as a whole was uniform, thereby exhibiting the most balanced performance.

In the experiment, when the supplying roller 25*c* has the shape of Sample 10, it was possible to perform the printing operation without the print quality problem at the contact pressure equal to or greater than 0.15 kgf/cm$^2$, or equal to or smaller than 0.20 kgf/cm$^2$ until the drum count became 30,000. However, when the contact pressure became 0.24 kg/cm$^2$, the stain occurred on the driven side due to the yielding.

As shown in Table 11 and FIG. 11(*c*), when the contact pressure became 0.20 kg/cm$^2$, the wear amount (yielding) at the point D3 became excessive. This is because there was the large difference in the outer diameters at the point D1 on the non-driven side and the point D2 at the middle, thereby decreasing the contact pressure on the non-driven side. As a result, the contact pressure on the driven side became excessive with the middle as a pivot, thereby increasing the wear amount (yielding) on the driven side.

As described above, in the third embodiment, the supplying roller 25*c* is formed in the shape such that the outer diameters ϕD1, ϕD2, and ϕD3 thereof at the points D1, D2, and D3 satisfy the condition of ϕD2>ϕD1>ϕD3 under the condition in which the contact pressure between the developing roller 23 and the supplying roller 25*c* is equal to or greater than 0.15 kgf/cm$^2$, or equal to or smaller than 0.20 kgf/cm$^2$. Further, it is preferred that the difference between ϕD1 and ϕD2 is between 0.1 mm and 0.3 mm, and the difference between ϕD2 and ϕD3 is between 0.4 mm and 0.6 mm. Accordingly, it is possible to reduce the wear amount (yielding) due to the excessive contact pressure on the driven side, to reduce the stain due to the yielding up to 1.5 times of the life of the image forming unit 20, and to obtain an image with good quality.

It should be noted that the difference between ϕD1 and ϕD2 and the difference between ϕD2 and ϕD3 are variable according to the arrangement of the photosensitive drum gear 304, the developing roller gear 303, the drive transmission gear 302, and the supplying roller gear 301, and the load torque of each roller. Accordingly, it is preferable that the difference between ϕD1 and ϕD2 and the difference between ϕD2 and ϕD3 are determined through an experiment.

As described above, in the third embodiment, the supplying roller 25*c* is formed in the shape such that the outer diameters ϕD1, ϕD2, and ϕD3 thereof at the points D1, D2, and D3 satisfy the condition of ϕD2>ϕD1>ϕD3 under the condition in which the contact pressure between the developing roller 23 and the supplying roller 25*c* is equal to or greater than 0.15 kgf/cm$^2$, or equal to or smaller than 0.20 kgf/cm$^2$. The point D1 is located at the position 5.0 mm away from the end portion on the non-drive transmission side of the conductive foamed layer 200 of the supplying roller 25*c* toward the opposite end portion on the driven side. Similarly, the point D2 is located at the position away from the end portion by 110.0 mm, and the point D3 is located at the position away from the end portion by 215.0 mm. Further, it is preferred that the difference between ϕD1 and ϕD2 is between 0.1 mm and 0.3 mm, and the difference between ϕD2 and ϕD3 is between 0.4 mm and 0.6 mm. Accordingly, it is possible to prolong the life of the image forming unit 20, and to obtain an image with good quality.

In the first to third embodiments, the printer 1 is explained as the image forming apparatus. The present invention is not limited thereto, and may be applicable to a copier, a facsimile, a multi-function product (MFP), and the like.

The disclosure of Japanese Patent Application No. 2012-123691, filed on May 30, 2012, is incorporated in the application.

While the invention has been explained with reference to the specific embodiments of the invention, the explanation is illustrative and the invention is limited only by the appended claims.

What is claimed is:

1. A developing device comprising:

a static latent image supporting member having a photosensitive layer and being arranged to be rotatable;

a developer supporting member arranged to be rotatable for developing a static latent image formed on the static latent image supporting member using developer to form an image;

a developer supplying member arranged to contact with the developer supporting member and be rotatable for supplying developer; and a drive transmission unit disposed on a side of same end portions of the developer supporting member and the developer supplying member for rotating the developer supporting member and the developer supplying member in a same rotational direction, wherein said developer supplying member is formed so that an outer diameter thereof on a side of the drive transmission unit becomes smaller than an outer diameter thereof on an opposite side.

2. The developing device according to claim 1, wherein said drive transmission unit includes a first gear disposed at one end portion of the developer supporting member, a second gear disposed at one end portion of the developer supplying member, and a third gear disposed between the first gear and the second gear to engage with the first gear and the second gear so that a drive force is transmitted from the first gear to the second gear.

3. The developing device according to claim 1, wherein said developer supplying member includes a surface layer formed of a conductive foamed layer.

4. The developing device according to claim 1, wherein said developer supplying member is formed in a shape so that outer diameters ϕD1, ϕD2, and ϕD3 thereof at points D1, D2, and D3 satisfy a condition of ϕD1>ϕD2>ϕD3 under a condition in which a contact pressure between the developer supplying member and the developer supporting member is less than 0.10 kgf/cm$^2$, said developer supplying member has a total length of 220.0 mm in a rotational axis direction thereof, said point D1 is located at a position 5.0 mm away from an end portion of the developer supplying member on the opposite side toward the side of the drive transmission unit, said point D2 is located at a position away from the end portion by 110.0 mm, said point D3 is located at a position away from the end portion by 215.0 mm, a difference between ϕD1 and ϕD2 is between 0.1 mm and 0.2 mm, and a difference between ϕD2 and ϕD3 is between 0.1 mm and 0.2 mm.

5. The developing device according to claim 1, wherein said developer supplying member is formed in a shape so that outer diameters ϕD1, ϕD2, and ϕD3 thereof at points D1, D2, and D3 satisfy a condition of ϕD1≈ϕD2>ϕD3 under a condition in which a contact pressure between the developer supplying member and the developer supporting member is equal to or greater than 0.10 kgf/cm$^2$, or equal to or smaller than 0.15 kgf/cm$^2$, said developer supplying member has a total length of 220.0 mm in a rotational axis direction thereof, said point D1 is located at a position 5.0 mm away from an end portion of the developer supplying member on the opposite side toward the side of the drive transmission unit, said point D2 is located at a position away from the end portion by 110.0 mm, said point D3 is located at a position away from the end portion by 215.0 mm, a difference between ϕD1 and ϕD2 is ±0.05 mm, and a difference between ϕD2 and ϕD3 is between 0.4 mm and 0.6 mm.

6. The developing device according to claim 1, wherein said developer supplying member is formed in a shape so that outer diameters ϕD1, ϕD2, and ϕD3 thereof at points D1, D2, and D3 satisfy a condition of ϕD2>ϕD1>ϕD3 under a condition in which a contact pressure between the developer supplying member and the developer supporting member is equal to or greater than 0.15 kgf/cm$^2$, or equal to or smaller than 0.20 kgf/cm$^2$, said developer supplying member has a total length of 220.0 mm in a rotational axis direction thereof, said point D1 is located at a position 5.0 mm away from an end portion of the developer supplying member on the opposite side toward the side of the drive transmission unit, said point D2 is located at a position away from the end portion by 110.0 mm, said point D3 is located at a position away from the end portion by 215.0 mm, a difference between ϕD1 and ϕD2 is between 0.1 mm and 0.3 mm, and a difference between ϕD2 and ϕD3 is between 0.4 mm and 0.6 mm.

7. An image forming apparatus, comprising:

a static latent image supporting member having a photosensitive layer and being arranged to be rotatable;

a developer supporting member arranged to be rotatable for developing a static latent image formed on the static latent image supporting member using developer to form an image;

a developer supplying member arranged to contact with the developer supporting member and be rotatable for supplying developer; and a drive transmission unit disposed on a side of same end portions of the developer supporting member and the developer supplying member for rotating the developer supporting member and the developer supplying member in a same rotational direction, wherein said developer supplying member is formed so that an outer diameter thereof on a side of the drive transmission unit becomes smaller than an outer diameter thereof on an opposite side.

* * * * *